US005791356A

United States Patent [19]

Muzzipapa

[11] Patent Number: 5,791,356

[45] Date of Patent: Aug. 11, 1998

[54] HAIR PERM ROD WITH NOTCHES AND/OR CHANNELS

[76] Inventor: Lucy Muzzipapa, 13 Weston Rd., Somerville, N.J. 08876

[21] Appl. No.: 879,387

[22] Filed: Jun. 20, 1997

[51] Int. Cl.[6] ..... A45D 2/08

[52] U.S. Cl. ..... 132/250; 132/248; 132/268; 132/253

[58] Field of Search ..... 132/250, 248, 132/253, 254, 245, 261, 210, 211, 268, 260, 259

[56] References Cited

U.S. PATENT DOCUMENTS

| | | | |
|---|---|---|---|
| 2,825,344 | 3/1958 | Lenois | 132/250 |
| 4,624,270 | 11/1986 | Hinton et al. | 132/248 |
| 4,699,160 | 10/1987 | Wiggin | 132/248 |
| 4,993,441 | 2/1991 | Hanson | 132/250 |
| 5,215,107 | 6/1993 | Van Divner | 132/248 |
| 5,285,800 | 2/1994 | Powers-McCarthy | 132/250 |
| 5,474,096 | 12/1995 | Dohmen | 132/252 |
| 5,487,396 | 1/1996 | Wilson | 132/248 |

*Primary Examiner*—John J. Wilson
*Assistant Examiner*—Pedro Philogene
*Attorney, Agent, or Firm*—Ezra Sutton

[57] ABSTRACT

A hair perm rod for permming hair including a cylindrical hollow rod having a center section with a knurled surface, and having an integrally attached end wall with a perimeter wall edge at one end of the hollow rod; and a detachable end cap with a perimeter wall edge at the other end of the hollow rod. The hair perm rod further includes a plurality of ventilation and liquid holes formed within the center section of the hollow rod; and a plurality of hair gripper teeth formed on knurled surface of the hollow rod. In addition, the hair perm rod also includes an elastic band having a first and a second end for connecting to the end wall and end cap, respectively. The end wall includes a first plurality of notches extending in a radial direction and a center hole formed therein for receiving the first end of the elastic band. The end cap includes a second plurality of notches extending in a radial direction and a center hole formed therein for receiving the second end of the elastic band. The elastic band is received within one of the first plurality of notches and is also received within one of the second plurality of notches to hold the hair securely in place.

29 Claims, 11 Drawing Sheets

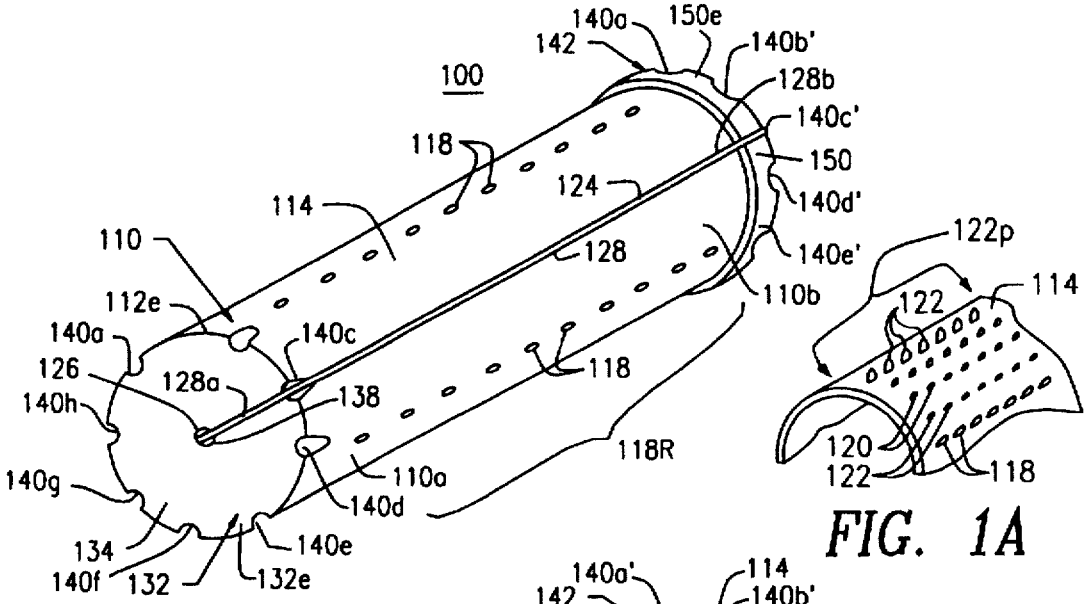
FIG. 1
FIG. 1A
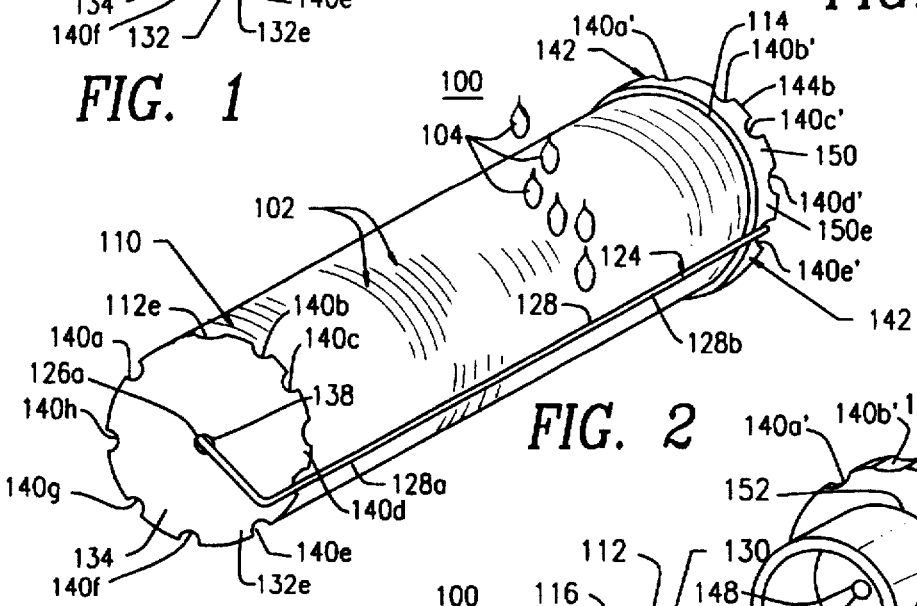
FIG. 2
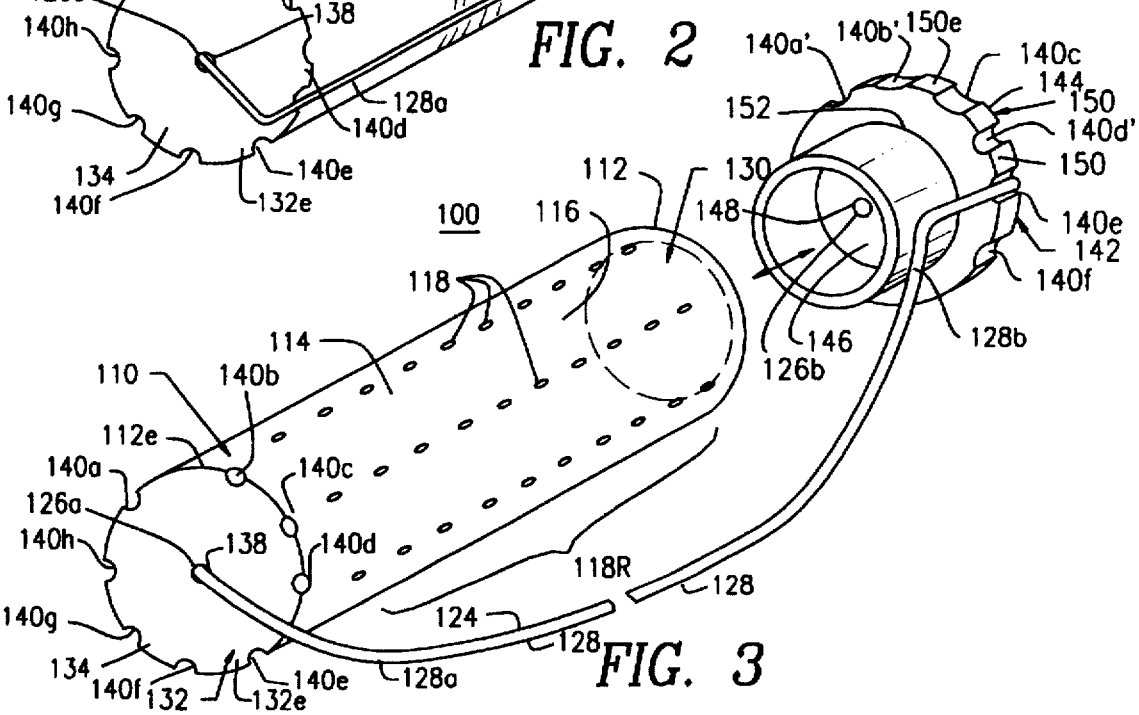
FIG. 3

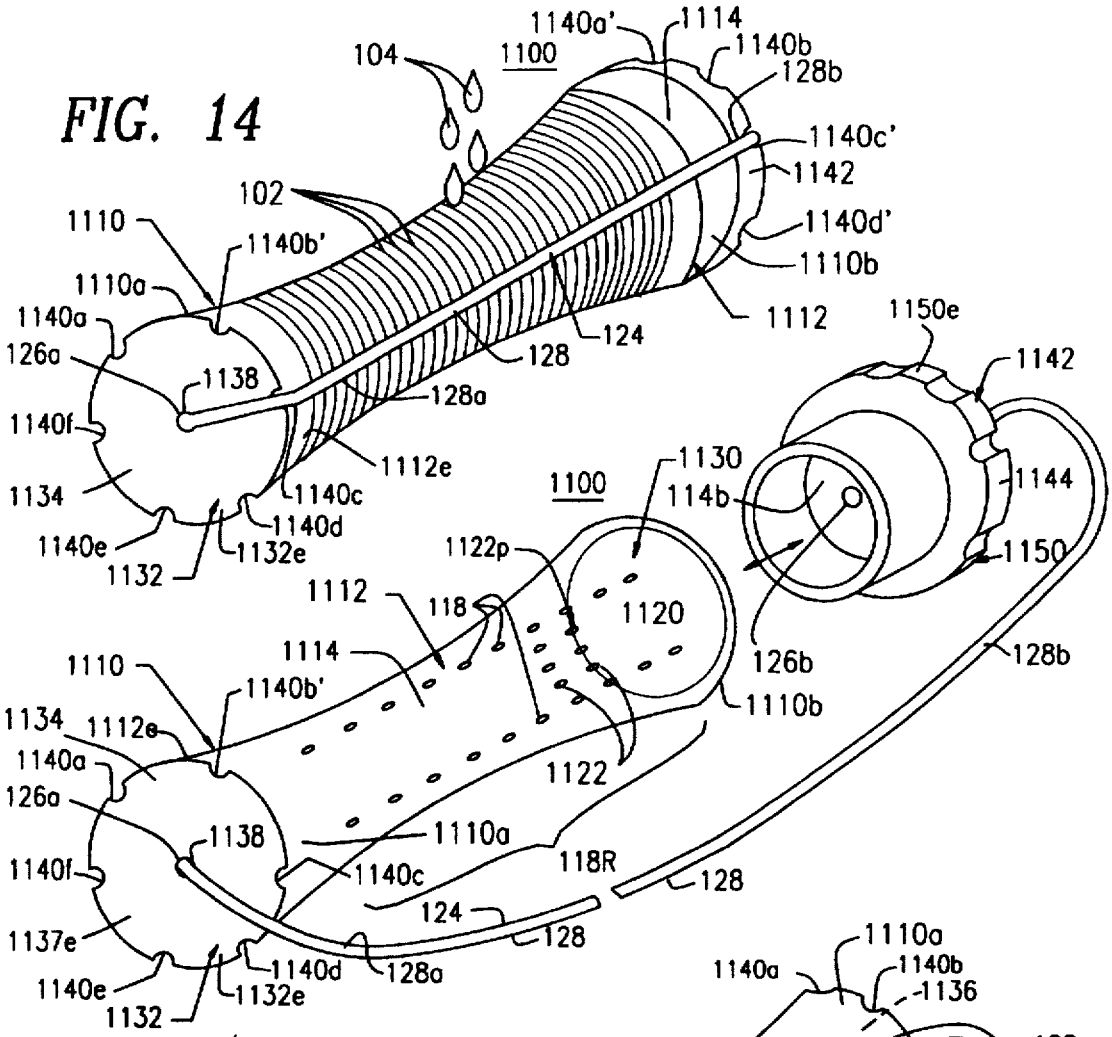
FIG. 14
FIG. 15
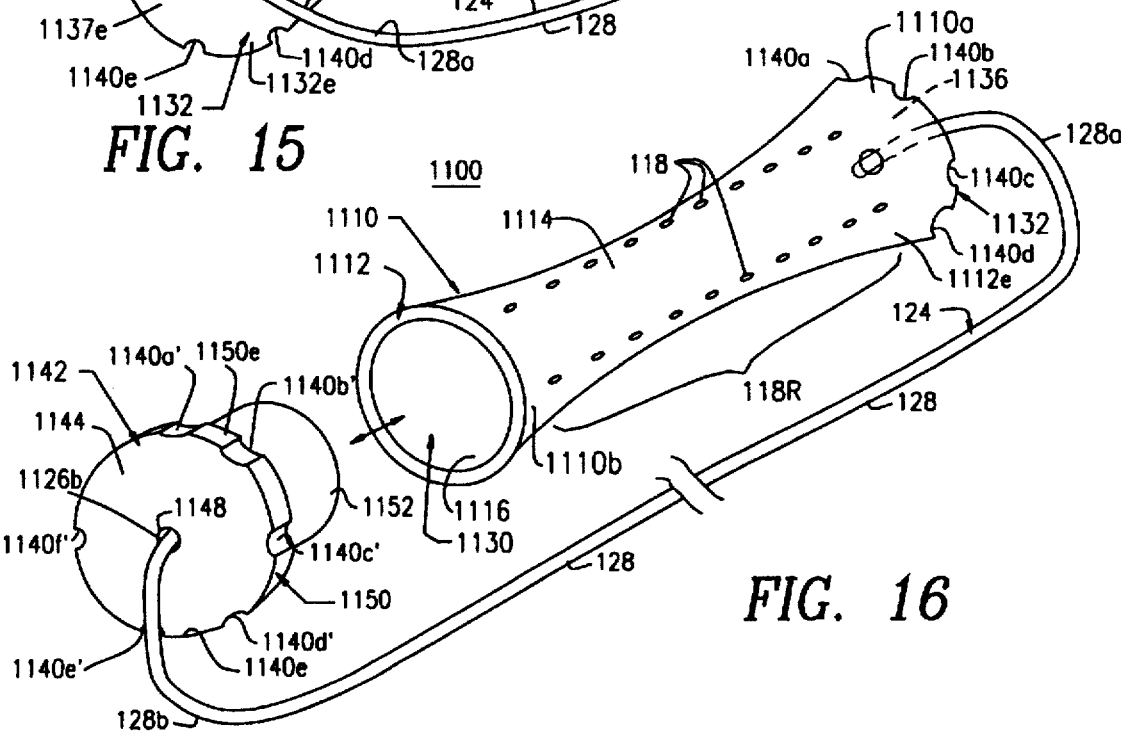
FIG. 16

FIG. 22
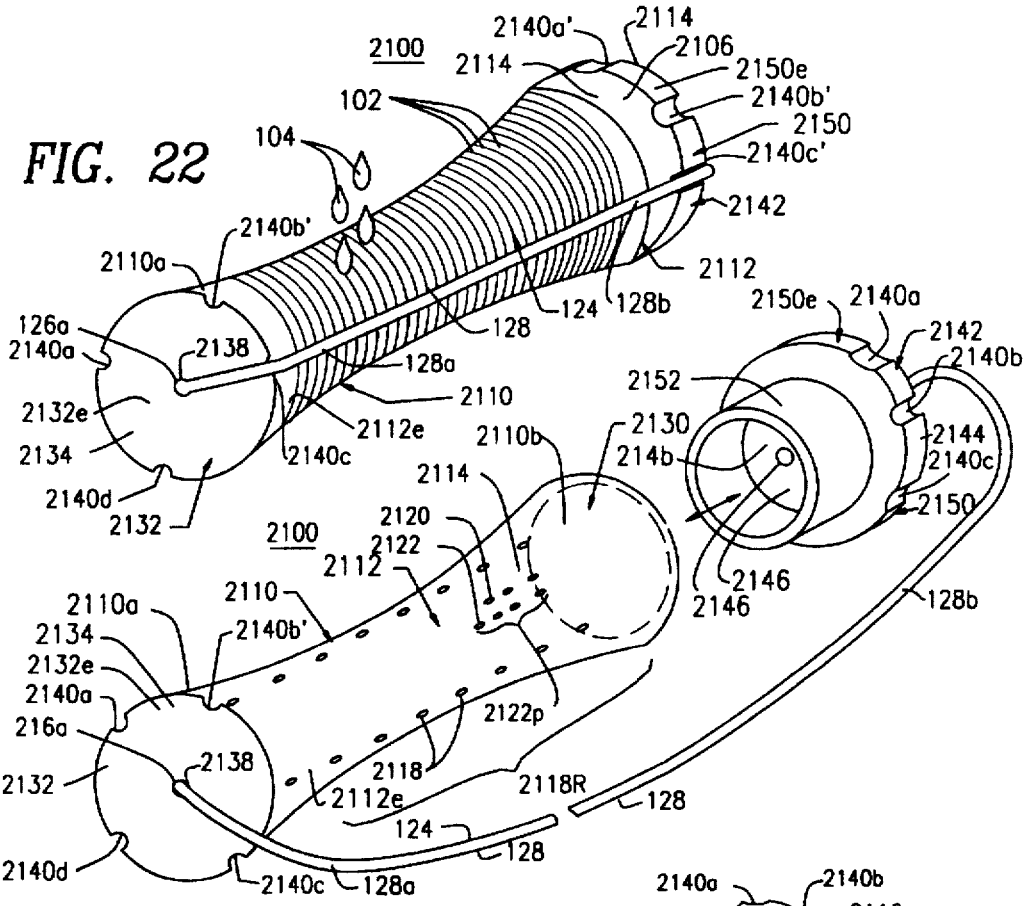
FIG. 23
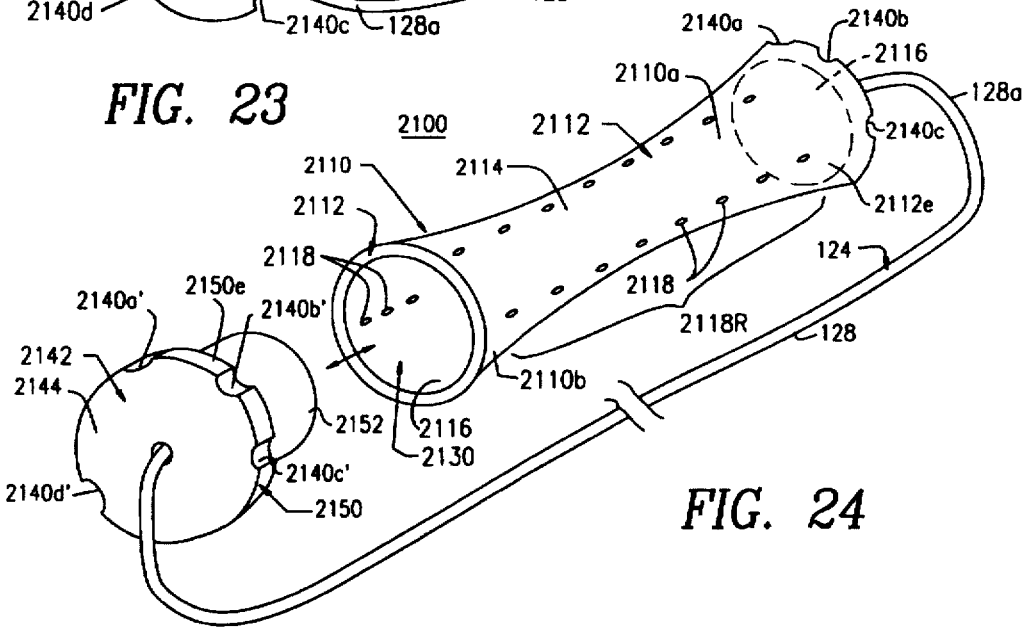
FIG. 24

HAIR PERM ROD WITH NOTCHES AND/OR CHANNELS

FIELD OF THE INVENTION

This invention relates to an improved hair perm rod, and more particularly, this invention relates to a hair perm rod having an integrally attached end wall and detachable end cap with notches and/or channels for preventing the elastic band from popping-off the rod housing when in operational use.

BACKGROUND OF THE INVENTION

Hair perm rods of various designs and configurations are used in preparation of giving a womans' hair a permanent with the application of a chemical perm solution thereon. In using the chemical solution for the permanent hair treatment procedure, the perm solution is applied to a given lock of hair consisting of a previously permed section that has grown out from the scalp; and a new hair growth section which is close to the scalp, having subsequently surfaced since the previous perm treatment procedure. The hairdresser in using current hair treatment methods for perms, typically winds a given lock of hair on a hair perm rod with end paper, and wraps the lock of hair between two to three times in a clockwise or counter-clockwise manner depending upon the type of curl, perm wanted by the user. The hairdresser then attaches an elastic cord/band to that hair section via the hair perm rod in which that wound section of hair is held in place against the scalp of the users' head. The hairdresser then applies the chemical perm solution to that lock of hair in which to form a perm on that hair section.

Hair perm rods of present day design have a problem of unwinding and unraveling on the users' hair because the elastic cord/band does not provide sufficient tension against the users' hair and perm rod, as the perm rod has the natural propensity to unwind and unravel because it was wound-up tightly with the users' hair and wants to move away (unwind and unravel) from the users' scalp.

There remains a need for a hair perm rod having radial notches or radial tapered channels, or combinations of radial notches and radial tapered channels within the end wall and end cap of the perm rod housing. These radial notches and/or radial notches prevent the elastic band ends of the elastic cord/band from coming out of the aforementioned radial notches and/or radial tapered channels. These configurations of radial notches and/or radial tapered channels will provide proper and sufficient elastic band tension against the users' hair and perm rod housing, such that the hair perm rod will not unwind or unravel or move away from the users' scalp after the initial positioning by the hairdresser on the users' scalp.

DESCRIPTION OF THE PRIOR ART

Hair perm rods of various designs, styles, configurations and materials of construction have been disclosed in the prior art. For example, U.S. Pat. No. 4,249,549 discloses a root perm rod having the curling rod and wound hair enclosed within a slotted, split cylindrical casing.

U.S. Pat. No. 5,215,107 discloses a spiral hair curler having a cylindrical body with a helically wound rib along the length of the cylindrical wall which provides a recessed guide channel for the hair strands to be gathered into when in operational use. An elastic band is used across the curler to restrain the hair from coming out of the helical channels within the curler.

U.S. Pat. No. 5,474,096 discloses a double back (hair) rod having a hollow cylindrical rod with first and second end clips, a plurality of gripper teeth formed on center section of the hollow cylindrical rod, and a plurality of ventilation hole openings formed within the cylindrical wall in the center section of the hollow cylindrical rod.

U.S. Pat. No. 5,487,396 discloses a permanent rod kit where the perm rod has a tight wrap section and a loose wrap section of differing diameters where the hair strands are wrapped and held in place with an elastic band.

None of the prior art patents disclose a hair perm rod having radial notches or radial tapered channels in which to prevent the moving of the hair perm rod away the users' scalp, as the elastic band will now provide sufficient tension on the users' hair and perm rod housing to also prevent any unwinding or unraveling of the hair section from the perm rod housing when in operational use.

Accordingly, it is an object of the present invention to provide a hair perm rod that is easy to use and which prevents the hair section being permed from unraveling or unwinding from the hair perm rod when in operational use.

Another object of the present invention is to provide a hair perm rod that is adjustable such that the hair sections being permed on the hair perm rods are adjacent to the users' scalp, as well as, the hair perm rods are in an immobile position adjacent to the users' scalp.

Another object of the present invention is to provide a hair perm rod that includes a plurality of radial notches, radial channels or combinations of radial notches and radial channels on the end wall and end cap, respectively, for the receipt of the elastic end sections of an elastic band which prevents the poppingout of the elastic end sections of the elastic band within the aforementioned radial notches and/or radial channels thereof, when in operational use.

Another object of the present invention is to provide a hair perm rod having an end cap that is detachable, as well as, rotatable within the hole opening of the perm rod housing for further adjusting the hair perm rod and the elastic band in relationship to the hair perm rod being adjacent to the users' scalp for enabling the hair perm rod to continue to be in an immobile position, such that the hair section will not unravel when in operational use.

Another object of the present invention is to provide a hair perm rod having a plurality of ventilation hole opening arranged in two or more rows along the length of perm rod housing for helping to evaporate the chemical perming solution from the hair sections on the hair perm rods in the hair drying process.

Another object of the present invention is to provide a hair perm rod having a plurality of pre-arranged hair gripper teeth on a knurled surface in which to help grab the strands of hair to the outer wall surface of the perm rod housing, thus enabling each hair section to be held tightly against the knurled surface of the perm rod housing.

Another object of the present invention is to provide a hair perm rod having an elastic band or elastic cord with spherical tab ends for retaining the aforementioned tab ends of the elastic band securely to the inner wall surfaces of the end wall and end cap, respectively, in which to prevent the elastic band ends from coming out of the end wall and/or end cap, respectively. A further object of the present invention is to provide a hair perm rod that can be mass produced in an automated and economical manner and being readily affordable by the user or hairdresser.

SUMMARY OF THE INVENTION

In accordance with the present invention there is provided a hair perm rod for perming hair. The hair perm rod includes a cylindrical hollow rod having a center section with a knurled surface, and having an integrally attached end wall with a perimeter wall edge at one end of the hollow rod; and a detachable end cap with a perimeter wall edge at the other end of the hollow rod. The hair perm rod further includes a plurality of ventilation and liquid holes formed within the center section of the hollow rod; and a plurality of hair gripper teeth formed on the knurled surface of the hollow rod. In addition, the hair perm rod also includes an elastic band having a first and a second end for connecting to the end wall and end cap, respectively.

The end wall includes a first plurality of notches extending in a radial direction and a center hole formed therein for receiving the first end of the elastic band. The end cap includes a second plurality of notches extending in a radial direction and a center hole formed therein for receiving the second end of the elastic band. The elastic band is received within one of the first plurality of notches and is also received within one of the second plurality of notches to hold the hair securely in place.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein:

FIG. 1 is a front perspective view of the hair perm rod of the first preferred embodiment of the present invention showing the hair perm rod housing having an integrally attached end wall with a plurality of radial notches therein; the elastic band for holding a lock of hair in place; and the end cap being detachably connected to the hair perm rod housing via the end hole opening;

FIG. 1A is an enlarged partial perspective view of the hair perm rod of the first preferred embodiment of the present invention showing the knurled surface having a plurality of gripper teeth, thereon; and a plurality of ventilation hole openings within the cylindrical wall of the hair perm rod housing;

FIG. 2 is a front perspective view of the hair perm rod of the first preferred embodiment of the present invention showing the hair perm rod in operational use in which a lock of hair is secured to the rod housing by the elastic band via notches within the end wall and end cap;

FIG. 3 is an exploded front perspective view of the hair perm rod of the first preferred embodiment of the present invention showing the hair perm rod housing having an integrally attached end wall with a plurality of radial notches therein, the elastic band, and the end cap;

FIG. 14 is a front perspective view of the hair perm rod of the second preferred embodiment of the present invention showing the hair perm rod in operational use in which a lock of hair is secured to the rod housing by the elastic band via notches within the end wall and end cap;

FIG. 15 is an exploded front perspective view of the hair perm rod of the second preferred embodiment of the present invention showing the hair perm rod housing having an integrally attached end wall with a plurality of radial notches therein; the elastic band, and the end cap;

FIG. 16 is an exploded rear perspective view of the hair perm rod of the second preferred embodiment of the present invention showing the hair perm rod housing, the end hole opening of the rod housing; the elastic band; and the end cap;

FIG. 22 is a front perspective view of the hair perm rod of the third preferred embodiment of the present invention showing the hair perm rod in operational use in which a lock of hair is secured to the rod housing by the elastic band via notches within the end wall and end cap;

FIG. 23 is an exploded front perspective view of the hair perm rod of the third preferred embodiment of the present invention showing the hair perm rod having an integrally attached end wall with a plurality of radial notches therein; the elastic band; and the end cap;

FIG. 24 is an exploded rear perspective view of the hair perm rod of the third preferred embodiment of the present invention showing the hair perm rod housing; the end hole opening of the rod housing; the elastic band; and the end cap;

DETAILED DESCRIPTION OF THE PREFERRED AND ALTERNATE EMBODIMENTS

OVERVIEW

Figure 4:
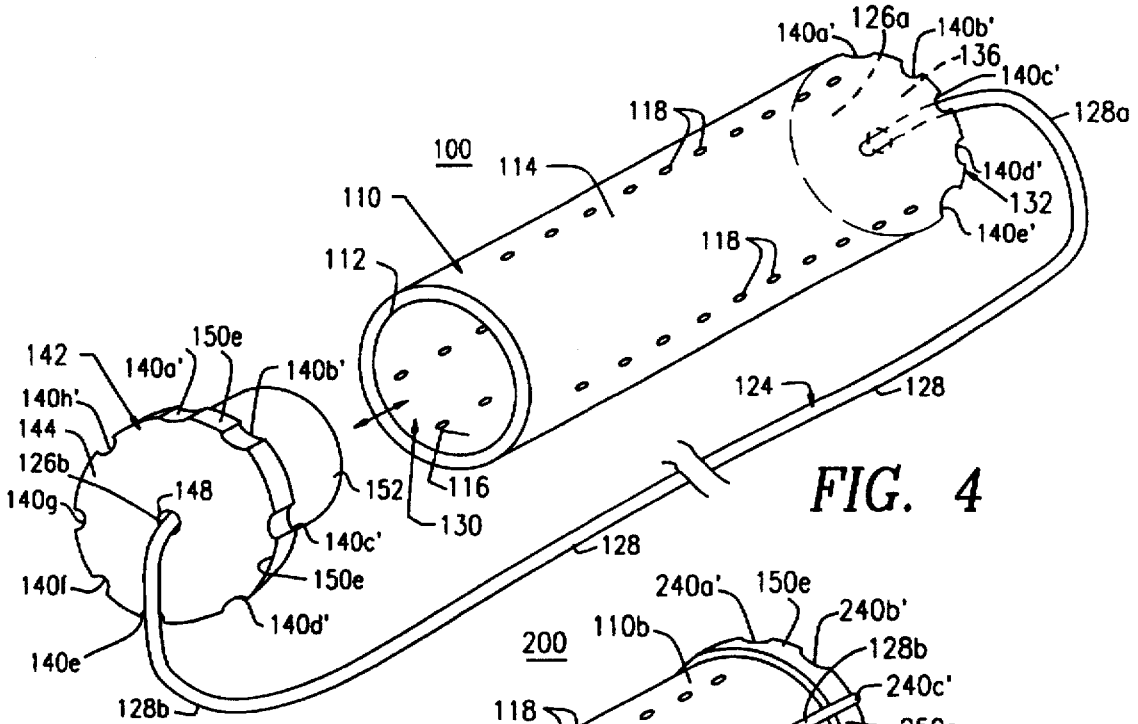
FIG. 4 is an exploded rear perspective view of the hair perm rod of the first preferred embodiment of the present invention showing the hair perm rod housing, the end hole opening, the elastic band, and the end cap.

The hair perm rod and its component parts of the first preferred embodiment 100 and its alternate embodiments 200, 300, 400 and 500 are represented in detail by FIGS. 1 through 13 of the drawings. The hair perm rod 100 of the first preferred embodiment and their alternate embodiments 200, 300, 400, and 500 are categorized as a "large size" hair perm rod for working on a longer length of hair to provide a larger curl/perm on the hair of the user. As shown in FIGS. 5 to 8 and 10 to 13, the alternate embodiments 200, 300, 400, and 500 only differ from the first preferred embodiment 100 in the design and configuration of the end wall 132 and end cap 142 of rod housing 110 which are different. In all other respects, the hair perm rods 200, 300, 400, and 500 of the alternate embodiments function and operate in the same manner as the hair perm rod 100 of the first preferred embodiment.

The hair perm rod and its component parts of the second preferred embodiment 1100 and its alternate embodiments 1200, 1300, 1400, and 1500 are represented in detail by FIGS. 14 through 21 of the drawings. The hair perm rod 1100 of the second preferred embodiment and their alternate embodiments 1200, 1300, 1400, and 1500 are categorized as a "medium size" hair perm rod for working on a medium length of hair to provide a moderate curl/perm on the hair of the user. As shown in FIGS. 18 to 21, the alternate embodiments 1200, 1300, 1400, and 1500 only differ from the second preferred embodiment 1100 in the design and configuration of the end wall 1132 and end cap 1142 of rod housing 1110 which are different. In all other respects, the hair perm rods 1200, 1300, 1400, and 1500 of the alternate embodiments function and operate in the same manner as the hair perm rod 1100 of the second preferred embodiment.

The hair perm rod and its component parts of the third preferred embodiment 2100 and its alternate embodiments 2200, 2300, 2400, and 2500 are represented in detail by FIGS. 22 through 29 of the drawings. The hair perm rod 2100 of the third preferred embodiment and their alternate embodiments 2200, 2300, 2400, and 2500 are categorized as a "small size" hair perm rod for working on a short length of hair to provide a small or tight curl/perm on the hair of the user. As shown in FIGS. 26 to 29, the alternate embodiments 2200, 2300, 2400, and 2500 only differ from the third preferred embodiment 2100 in the design and configuration of the end wall 2132 and end cap 2142 of rod housing 2110 which are different. In all other respects, the hair perm rods 2200, 2300, 2400, and 2500 of the alternate embodiments function and operate in the same manner as the hair perm rod 2100 of the third preferred embodiment.

The hair perm rods of the first, second and third preferred embodiments 100, 1100, and 2100 and their respective alternate embodiments may be made of a moldable, heavy duty plastic that is also durable and cleanable for multiple and repeated use by the hairdresser and/or home user.

FIRST PREFERRED EMBODIMENT 100

The hair perm rod 100 and its component parts of the first preferred embodiment of the present invention are represented in detail by FIGS. 1 through 4 and 9. The hair perm rod 100, as shown in FIGS. 1 and 3, includes a cylindrical hollow rod housing 110 having a cylindrical wall 112, an integrally attached end wall 132 at one end **110*a* and a circular hole opening 130 at the other end 110*b* for receipt of a detachable and removable cylindrical end cap 142. Cylindrical wall 112 includes an outer wall surface 114, an inner wall surface 116, and a plurality of ventilation hole openings 118 arranged in rows 118R along the length of cylindrical wall 112; and with each row 118R set apart at a 90° degree angle around the peripherical circumference of cylindrical wall 112. Outer wall surface 114 includes a knurled surface 120 having a plurality of hair gripper teeth 122 arranged in a pre-determined pattern 122P. The plurality of hair gripper teeth 122 function to help grab a given lock (strands of hair) of hair 102 to the outer wall surface 114 of perm rod 100 for perming by a perming solution 104**.

Figure 9:
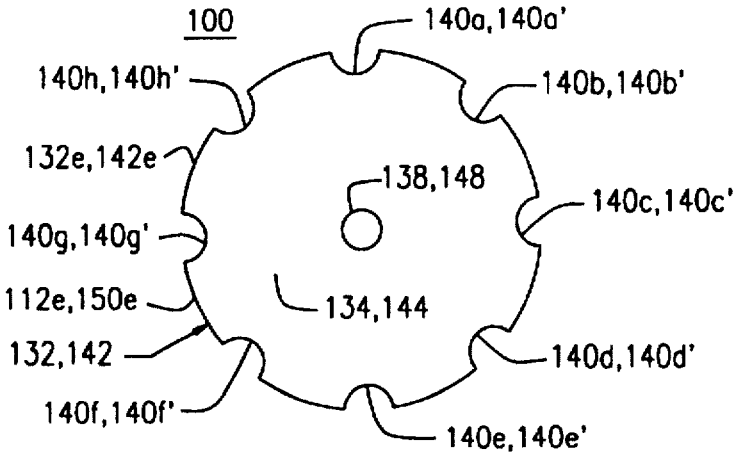
FIG. 9 is an enlarged side elevational view of the hair perm rod of the first preferred embodiment of the present invention showing the outer wall surface of the end wall or end cap having a plurality of radial notches therein.

End wall 132 includes an outer wall surface 134, an inner wall surface 136, and a center hole opening 138 for receipt of the spherical tab end 126*a* of the elastic band 124 within opening 138. Elastic band 124 includes a pair of spherical tab ends 126*a* and 126*b*, and an expandable center elastic section 128 having first and second end sections 128*a* and 128*b*, respectively. Outer wall surface 134 of end wall 132 further includes a first plurality of radial notches 140*a* to 140*h* for holding in place within one of the aforementioned notches 140*a* to 140*h* the first end section 128*a* of elastic section 128 of the elastic band 124. The notches 140a to 140*h* are arranged in a radial pattern, as shown in FIGS. 1, 3, and 9 of the drawings, such that each notch 140*a* to 140*h* is set apart at a 45° degree angle around the peripheral/perimeter wall edges 112*e* and 132*e* of cylindrical wall 112 and end wall 132, respectively. Each notch 140*a* to 140*h* is slightly indented within the perimeter wall edges 112*e* and 132*e* of cylindrical wall 112 and end wall 132, respectively; with each notch 140*a* to 140*h* having the indentation being a semi-spherical hollow shape.

End cap 142 includes an outer wall surface 144, an inner wall surface 146, a center hole opening 148 for receipt of the spherical tab end 126*b* of the elastic band 124 within opening 148, and an outer cylindrical wall surface 150 having an L-shaped circular perimeter wall edge 152 for receipt of end cap 142 within circular hole opening 130 of rod housing 110. Outer wall surface 144 of end cap 142 further includes a second plurality of radial notches 140*a*' to 140*h*' (identical in design, shape and configuration of notches 140*a* to 140*h*) for holding in place within one of the aforementioned notches 140*a*' to 140*h*' the second end section 128*b* of elastic section 128 of the elastic band 124. The notches 140*a*' to 140*h*' are also arranged in a radial pattern, as shown in FIG. 4 and 9 of the drawings, such that each notch 140*a*' to 140*h*' is set apart at a 45° degree angle around the perimeter wall edges 144*e* and 150*e* of the outer wall surface 144 and cylindrical wall surface 150, respectively. Each notch 140*a*' to 140*h*' is slightly indented within the perimeter wall edges 144*e* and 150*e* of outer wall surface 144 and cylindrical wall surface 150, respectively; with each notch 140*a*' to 140*h*' having the indentation being a semi-spherical hallow shape.

Elastic band 124 is detachably connected to both end wall 132 and end cap 142 via the spherical tab ends 126*a* and 126*b* located at the first and second end sections 128*a* and 128*b* of center elastic section 128, as shown in FIGS. 1, 2, 3, and 4 of the drawings. In particular, spherical tab end 126*a* is adjacent and in contact with inner surface wall 136 and center hole opening 138 of end wall 132; and spherical tab end 126*b* is adjacent and in contact with inner surface wall 146 and hole opening 148 of cylindrical end cap 142. The expandable elastic center section 128 functions to also hold the users' lock of hair 102 in place against the outer knurled surface 120 of perm rod housing 110, as shown in FIGS. 1, 1A, and 2 of the drawings.

It should be understood that the term "elastic band" as used herein includes the use of an elastic cord, a rubber band, a rubber cord, or any other stretchable material. In addition, preferably, the elastic band should be resistant to the chemical perming solution 104.

SECOND PREFERRED EMBODIMENT 1100

The hair perm rod 1100 and its component parts of the second preferred embodiment of the present invention are represented in detail by FIGS. 14 through 17. The hair perm rod 1100, as shown in FIGS. 15 and 16, includes a concave cylindrical hollow rod housing 1110 having a concave cylindrical wall 1112, an integrally attached end wall 1132 at one end 1110*a* and a circular hole opening 1130 at the other end 1110*b* for receipt of a detachable and removable cylindrical end cap 1142. Concave cylindrical wall 1112 includes an outer wall surface 1114, an inner wall surface 1116, and a plurality of ventilation hole openings 1118 arranged in rows 1118R along the length of cylindrical wall 1112; and with each row 1118R set apart at a 120° degree angle around the peripherical circumference of cylindrical wall 1112. Outer wall surface 1114 includes a knurled surface 1120 having a plurality of hair gripper teeth 1122 arranged in a pre-determined pattern 1122P. The plurality of hair gripper teeth 1122 function to help grab a given lock (strands of hair) of hair 102 to the outer wall surface 1114 of perm rod 1100 for perming by a perming solution 104.

Figure 17:
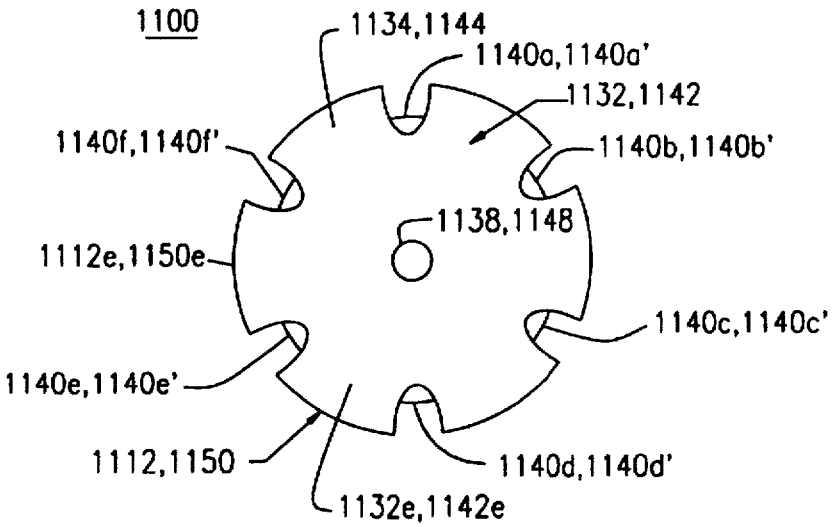
FIG. 17 is an enlarged side elevational view of the hair perm rod of the second preferred embodiment of the present invention showing the outer wall surface of the end wall or end cap having a plurality of radial notches therein.

End wall 1132 includes an outer wall surface 1134, an inner wall surface 1136, and a center hole opening 1138 for receipt of the spherical tab end 126*a* of the elastic band 124 within opening 1138. Elastic band 124 includes a pair of spherical tab ends 126*a* and 126*b*, and an expandable center elastic section 128 having first and second end sections 128*a* and 128*b*, respectively. Outer wall surface 1134 of end wall 1132 further includes a first plurality of radial notches 1140*a* to 1140*f* for holding in place within one of the aforementioned notches 1140*a* to 1140*f* the first end section 128*a* of elastic section 128 of the elastic band 124. The notches 1140*a* to 1140*f* are arranged in a radial pattern, as shown in FIGS. 14, 15, and 17 of the drawings, such that each notch 1140*a* to 1140*f* is set apart at a 60° degree angle around the peripheral/perimeter wall edges 1112*e* and 1132*e* of cylindrical wall 1112 and end wall 1132, respectively. Each notch 1140*a* to 1140*f* is slightly indented within the perimeter wall edges 1112*e* and 1132*e* of cylindrical wall 1112 and end wall 1132, respectively; with each HAIR PERM ROD WITH NOTCHES AND/OR CHANNELS notch 1140*a* to 1140*f* having the indentation being a semi-spherical hollow shape.

End cap 1142 includes an outer wall surface 1144, an inner wall surface 1146, a center hole opening 1148 for receipt of the spherical tab end 126*b* of the elastic band 124 within opening 1148, and an outer cylindrical wall surface 1150 having an L-shaped circular perimeter wall edge 1152 for receipt of end cap 1142 within circular hole opening 1130 of rod housing 1110. Outer wall surface 1144 of end cap 1142 further includes a second plurality of radial notches 1140*a*' to 1140*f* (identical in design, shape and configuration of notches 1140*a* to 1140*f*) for holding in place within one of the aforementioned notches 1140*a*' to 1140*f* the second end section 128*b* of elastic section 128 of the elastic band 124. The notches 1140*a*' to 1140*f* are also arranged in a radial pattern, as shown in FIG. 16 and 17 of the drawings, such that each notch 1140*a*' to 1140*f* is set apart at a 60° degree angle around the perimeter wall edges 1144*e* and 1150*e* of the outer wall surface 1144 and cylindrical wall surface 1150, respectively. Each notch 1140*a*' to 1140*f* is slightly indented within the perimeter wall edges 1144*e* and 1150*e* of outer wall surface 1144 and cylindrical wall surface 1150, respectively; with each notch 1140*a*' to 1140*f* having the indentation being a semi-spherical hallowed shape.

Elastic band 124 is detachably connected to both end wall 1132 and end cap 1142 via the spherical tab ends 126*a* and 126*b* located at the first and second end sections 128*a* and 128*b* of center elastic section 128, as shown in FIGS. 14, 15, and 16 of the drawings. In particular, spherical tab end 126*a* is adjacent and in contact with inner surface wall 136 and center hole opening 138 of end wall 132; and spherical tab end 126b is adjacent and in contact with inner surface wall 146 and hole opening 148 of cylindrical end cap 142. The expandable elastic center section 128 functions to also hold the users' lock of hair 102 in place against the outer knurled surface 1120 of perm rod housing 1110, as shown in FIG. 15 of the drawings.

THIRD PREFERRED EMBODIMENT 2100

The hair perm rod 2100 and its component parts of the preferred embodiment of the present invention are represented in detail by FIGS. 22 through 25. The hair perm rod 2100, as shown in FIGS. 23 and 24, includes a slender concave cylindrical hollow rod housing 2110 having a cylindrical wall 2112, an integrally attached end wall 2132 at one end 2110a and a circular hole opening 2130 at the other end 2110b for receipt of a detachable and removable cylindrical end cap 2142. Concave cylindrical wall 2112 includes an outer wall surface 2114, an inner wall surface 2116, and a plurality of ventilation hole openings 2118 arranged in two (2) rows 2118R along the length of cylindrical wall 2112; and with each row 2118R set apart at a 180° degree angle around the peripherical circumference of cylindrical wall 2112. Outer wall surface 2114 includes a knurled surface 2120 having a plurality of hair gripper teeth 2122 arranged in a pre-determined pattern 2122P. The plurality of hair gripper teeth 2122 function to help grab a given lock (strands of hair) of hair 102 to the outer wall surface 2114 of perm rod 2100 for perming by a perming solution 104.

Figure 25:
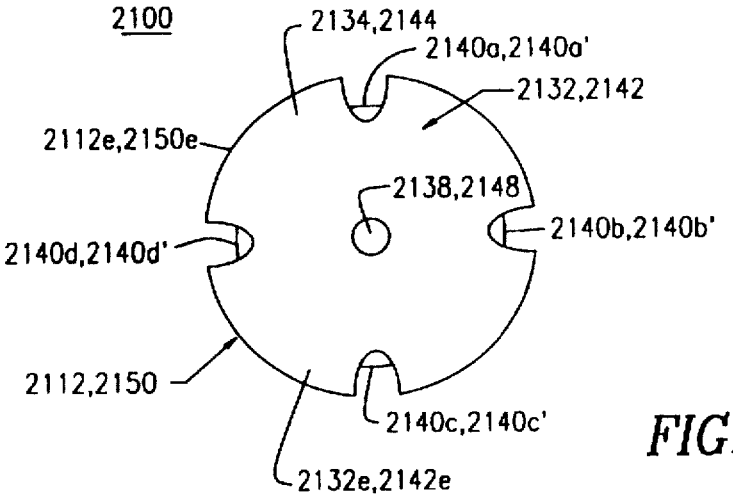
FIG. 25 is an enlarged side elevational view of the hair perm rod of the third preferred embodiments of the present invention showing the outer wall surface of the end wall or end cap having a plurality of radial notches therein.

End wall 2132 includes an outer wall surface 2134, an inner wall surface 2136, and a center hole opening 2138 for receipt of the spherical tab end 126a of the elastic band 124 within opening 2138. Elastic band 124 includes a pair of spherical tab ends 126a and 126b, and an expandable center elastic section 128 having first and second end sections 128a and 128b, respectively. Outer wall surface 2134 of end wall 2132 further includes a first plurality of radial notches 2140a to 2140d for holding in place within one of the aforementioned notches 2140a to 2140d the first end section 128a of elastic section 128 of the elastic band 124. The notches 2140a to 2140d are arranged in a radial pattern, as shown in FIGS. 22, 23, and 25 of the drawings, such that each notch 2140a to 2140d is set apart at a 90° degree angle around the peripheral/perimeter wall edges 2112e and 2132e of cylindrical wall 2122 and end wall 2132, respectively. Each notch 2140a to 2140d is slightly indented within the perimeter wall edges 2112e and 2132e of cylindrical wall 2112 and end wall 2132, respectively; with each notch 2140a to 2140d having the indentation being a semi-spherical hollow shape.

End cap 2142 includes an outer wall surface 2144, an inner wall surface 2146, a center hole opening 2148 for receipt of the spherical tab end 126b of the elastic band 124 within opening 2148, and an outer cylindrical wall surface 2150 having an L-shaped circular perimeter wall edge 2152 for receipt of end cap 2142 within circular hole opening 2130 of rod housing 2110. Outer wall surface 2144 of end cap 2142 further includes a second plurality of radial notches 2140a' to 2140d' (identical in design, shape and configuration of notches 2140a to 2140d) for holding in place within one of the aforementioned notches 2140a' to 2140d' the second end section 128b of elastic section 128 of the elastic band 124. The notches 2140a' to 2140d' are also arranged in a radial pattern, as shown in FIGS. 24 and 25 of the drawings, such that each notch 2140a' to 2140d' is set apart at a 90° degree angle around the perimeter wall edges 2144e and 2150e of the outer wall surface 2144 and cylindrical wall surface 2150, respectively. Each notch 2140a' to 2140d' is slightly indented within the perimeter wall edges 2144e and 2150e of outer wall surface 2144 and cylindrical wall surface 2150, respectively; with each notch 2140a' to 2140d' having the indentation being a semi-spherical hallowed shape.

Elastic band 124 is detachably connected to both end wall 2132 and end cap 2142 via the spherical tab ends 126a and 126b located at the first and second end sections 128a and 128b of center elastic section 128, as shown in FIGS. 22, 23, and 24 of the drawings. In particular, spherical tab end 126a is adjacent and in contact with inner surface wall 2136 and center hole opening 2138 of end wall 2132; and spherical tab end 126b is adjacent and in contact with inner surface wall 2146 and hole opening 2148 of cylindrical end cap 2142. The expandable elastic center section 128 functions to also hold the users' lock of hair 102 in place against the outer knurled surface 2120 of perm rod housing 2110, as shown in FIG. 23 of the drawings.

DETAILED DESCRIPTION OF ALTERNATE EMBODIMENTS

Alternate embodiments of the hair perm rod of the first preferred embodiment of the present invention are depicted in detail by FIGS. 5 to 8 and 10 to 13 of the drawings. All aspects of these alternate hair perm rods 200, 300, 400 and 500 are the same as the first preferred embodiment of the hair perm rod 100 except for the arrangement of the notches and channels. In these alternate embodiments the outer wall surfaces 134 and 144; and openings 138 and 148; and/or perimeter wall edges 112e, 132e, 144e and 150e of the end wall 132 and end cap 142, respectively, are different.

SECOND EMBODIMENT 200

Figure 5:
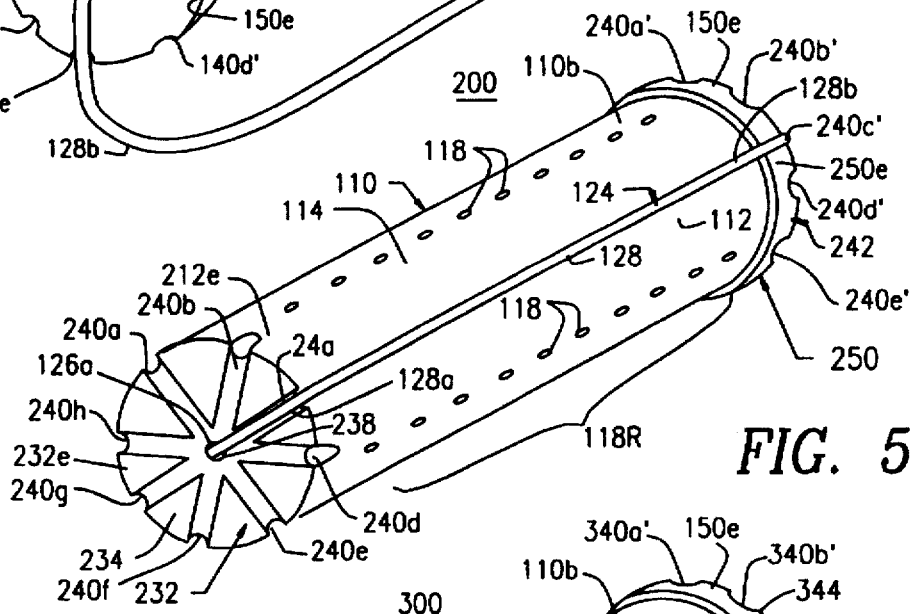
FIG. 5 is a front perspective view of the hair perm rod of the second embodiment of the first preferred embodiment showing the hair perm rod housing having an integrally attached end wall with a plurality of radial and tapered U-shaped channels thereon; the elastic band for holding a lock of hair in place; and the end ap being detachably connected to the hair perm rod housing via the end hole opening.
Figure 10:
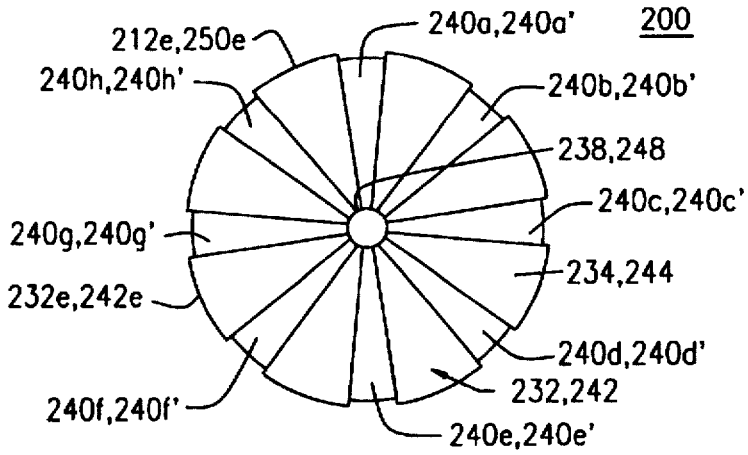
FIG. 10 is an enlarged side elevational view of the hair perm rod of the second embodiment of the first preferred embodiment of the present invention showing the outer wall surface of the end wall or end cap having a plurality of radial tapered U-shaped channels therein.

The hair perm rod 200 and its component parts of the second embodiment of the first preferred embodiment are represented in FIGS. 5 and 10 of the drawing. Outer wall surface 234 of end wall 232 includes a first plurality of radial tapered channels 240a to 240h for holding in place in any one of the aforementioned tapered channels 240a to 240h the first end section 128a of the elastic band 124. The tapered channels 240a to 240h are arranged in a radial pattern, such that each tapered channel 240a to 240h is spaced apart at a 45° degree angle around the outer wall surface 234 of end wall 232. Each tapered channel 240a to 240h is indented within the outer wall surface 234 and perimeter wall edge 212e of cylindrical wall 112, respectively; with each tapered channel 240a to 240h having a U-shaped indentation. Opening 238 receives spherical tab end 126a of elastic band 124.

Outer wall surface 244 of end cap 242 includes a second plurality of radial tapered channels 240a' to 240h' (identical in design, shape and configuration to tapered channels 240a to 240h) for holding in place in any one of the aforementioned tapered channels 240a' to 240h' the second end section 128b of the elastic band 124. The tapered channels 240a' to 240h' are also arranged in a radial pattern, such that each tapered channel 240a' to 240h' is also spaced apart at a 45° degree angle around the outer wall surface 144 of end cap 142. Each tapered channel 240a' to 240h' is indented within the outer wall surface 244 and perimeter wall edge 250e of outer cylindrical wall surface 250, respectively; with each tapered channel having the indentation being U-shaped. Opening 248 receives spherical tab end 126b of elastic band 124.

THIRD EMBODIMENT 300

Figure 6:
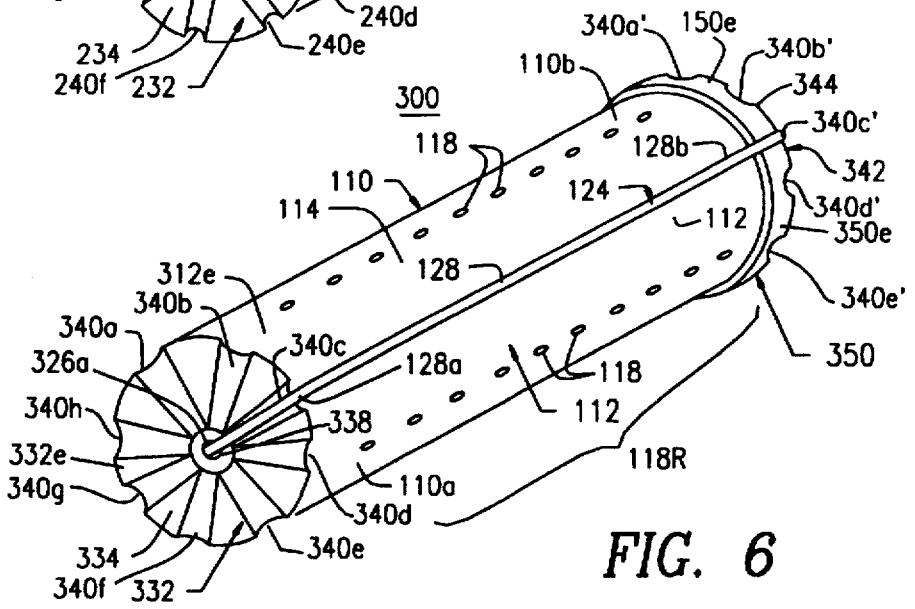
FIG. 6 is a front perspective view of the hair perm rod of the third embodiment of the first preferred embodiment showing the hair perm rod housing having an integrally attached end wall with a plurality of radial, wider and slightly tapered U-shaped channels thereon; the elastic bad for holding a lock of hair in place; and the end cap being detachably connected to the hair perm rod housing via the end hole opening.
Figure 11:
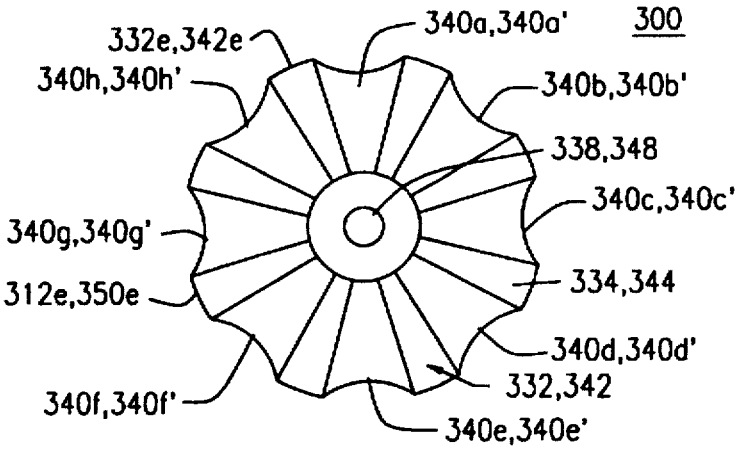
FIG. 11 is an enlarged side elevational view of the hair perm rod of the third embodiment of the first preferred embodiment of the present invention showing the outer wall surface of the end wall or end cap having a plurality of radial, slightly tapered U-shaped channels therein.

The hair perm rod 300 and its component parts of the third embodiment of the first preferred embodiment are represented in FIGS. 6 and 11 of the drawing. Outer wall surface 334 of end wall 332 includes a first plurality of radial, wider and slightly tapered channels 340*a* to 340*h* for holding in place in any one of the aforementioned slightly tapered channels 340*a* to 340*h* the first end section 128*a* of the elastic band 124. The slightly tapered channels 340*a* to 340*h* are arranged in a radial pattern, such that each slightly tapered channel 340*a* to 340*h* is spaced apart at a 45° degree angle around the outer wall surface 334 of end wall 332. Each slightly tapered channel 340*a* to 340*h* is indented within the outer wall surface 334 and perimeter wall edge 312*e* of cylindrical wall 112, respectively; with each slightly tapered channel 340*a* to 340*h* having a U-shaped indentation. Opening 338 receives spherical tab end 126*a* of elastic band 124.

Outer wall surface 344 of end cap 342 includes a second plurality of radial, wider and slightly tapered channels 340*a*' to 340*h*' (identical in design, shape and configuration to tapered channels 340*a* to 340*h*) for holding in place in any one of the aforementioned slightly tapered channels 340*a*' to 340*h*' the second end section 128*b* of the elastic band 124. The slightly tapered channels 340*a*' to 340*h*' are also arranged in a radial pattern, such that each slightly tapered channel 340*a*' to 340*h*' is also spaced apart at a 45° degree angle around the outer wall surface 344 of end cap 342. Each slightly tapered channel 340*a*' to 340*h*' is indented within the outer wall surface 344 and perimeter wall edge 350*e* of outer cylindrical wall surface 350, respectively; with each slightly tapered channel 340*a*' to 340*h*' having a U-shaped indentation. Opening 348 receives spherical tab end 126*b* of elastic band 124.

FOURTH EMBODIMENT 400

Figure 7:
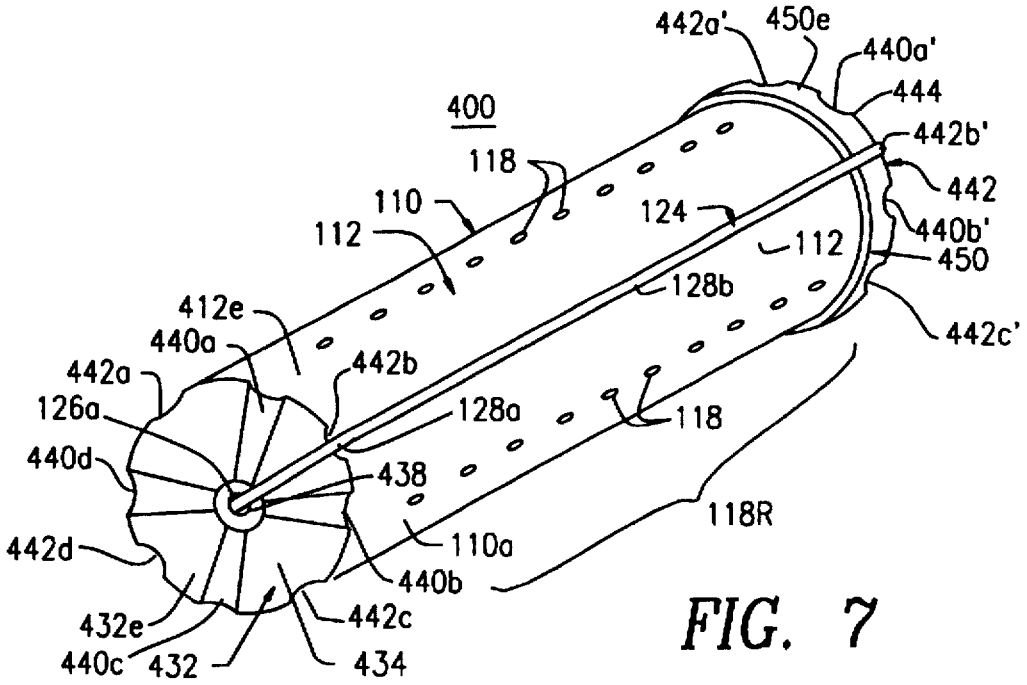
FIG. 7 is a front perspective view of the hair perm rod of the fourth embodiment and the first preferred embodiment showing the hair perm rod housing having an integrally attached end wall with a plurality of radial tapered U-shaped channels having notches and also with a plurality of radial notches thereon; the elastic band for holding a lock of hair in place; and the end cap being detachably connected to the hair perm rod housing via the end hole opening.
Figure 12:
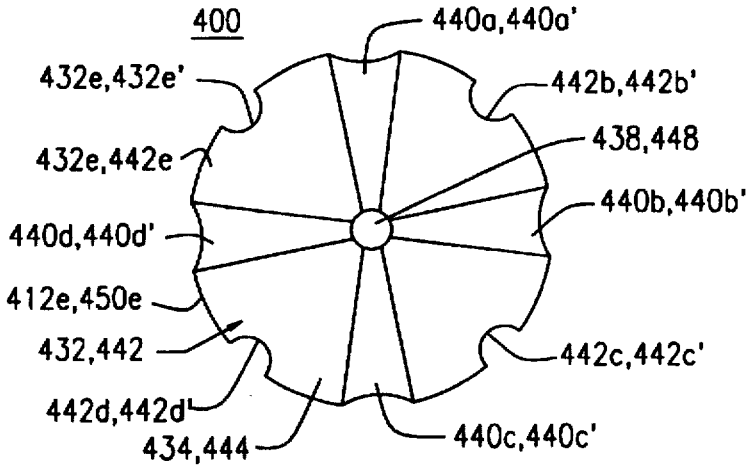
FIG. 12 is an enlarged side elevational view of the hair perm rod of the fourth embodiment of the first preferred embodiment of the present invention showing the outer wall surface of the end wall or end cap having a plurality of radial tapered U-shaped channels with notches and also having a plurality of radial notches therein.

The hair perm rod 400 and its component parts of the fourth embodiment of the first preferred embodiment are represented in FIGS. 7 and 12 of the drawings. Outer wall surface 434 of end wall 432 includes a first plurality of radial tapered channels with notches 440*a* to 440*d*; and a first plurality of radial notches 442*a* to 442*d* for holding in place in any one of the aforementioned tapered channels with notches 440*a* to 440*d* or notches 442*a* to 442*d* the first end section 128*a* of the elastic band 124. The tapered channels with notches 440*a* to 440*d* and notches 442*a* to 442*d* are arranged in a radial pattern, such that each tapered channel with a notch 440*a* to 440*d*; and each notch 442*a* to 442*d* is alternately spaced-apart at a 45° degree angle around the outer wall surface 434 of end wall 432. Each tapered channel with a notch 440*a* to 440*d*; and each notch 442*a* to 442*d* is indented within the outer wall surface 434 and perimeter wall edge 412*e* of cylindrical wall 112, respectively; with each tapered channel with a notch 440*a* to 440*d*; and each notch 442*a* to 442*d* having a U-shaped or spherical indentation, respectively. Opening 438 receives spherical end tab 126*a* of elastic band 124.

Outer wall surface 444 of end cap 442 includes a second plurality of radial tapered channels with notches 440*a*' to 440*d*'; and a second plurality of radial notches 442*a*' to 442*d*' (identical in design, shape and configuration to tapered channels with notches 440*a* to 440*d* and notches 442*a* to 442*d*) for holding in place in any one of the aforementioned tapered channels with notches 440*a*' to 440*d*' or notches 442*a*' to 442*d*' the second end section 128*b* of the elastic band 124. The tapered channels with notches 440*a*' to 440*d*'; and notches 442*a*' to 442*d*' are also arranged in a radial pattern, such that each tapered channel with a notch 440*a*' to 440*d*'; and each notch 442*a*' to 442*d*' is also alternately spaced-apart at a 45° degree angle around the outer wall surface 444 of end cap 442. Each tapered channel with a notch 440*a*' to 440*d*'; and each notch 442*a*' to 442*d*' is indented within the outer wall surface 444 and perimeter wall edge 450*e* of outer cylindrical wall surface 450, respectively; with each tapered channel with a notch 440*a*' to 440*d*', and each notch 442*a*' to 442*d*' having a U-shaped or spherical indentation, respectively. Opening 448 receives spherical end tab 126*b* of elastic band 124.

FIFTH EMBODIMENT 500

Figure 8:
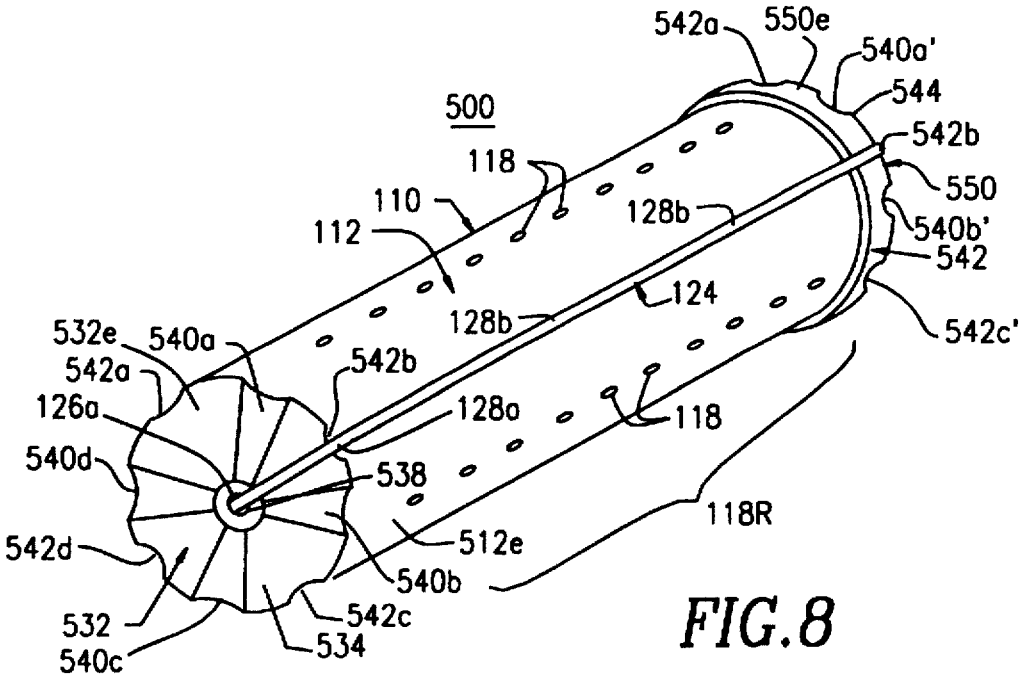
FIG. 8 is a front perspective view of the hair perm rod of the fifth embodiment of the first preferred embodiment showing the hair perm rod housing having an integrally attached end wall with a plurality of radial and slightly tapered U-shaped channels and also with a plurality of notches thereon; the elastic band for holding a lock of hair in place; and the end cap being detachably connected to the hair perm rod housing via the end hole opening.
Figure 13:
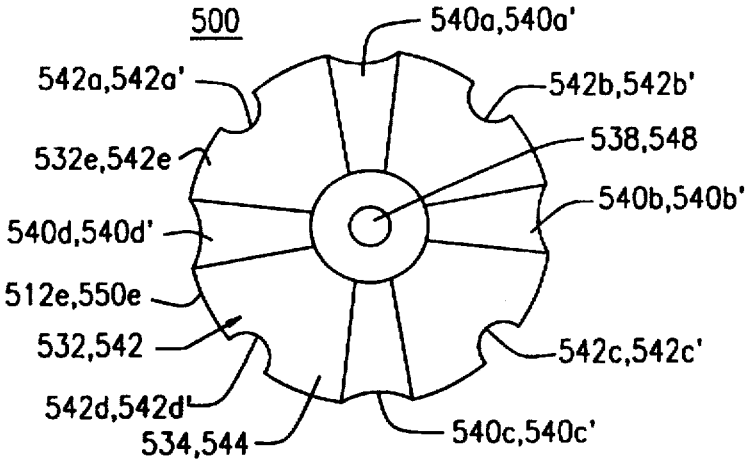
FIG. 13 is an enlarged side elevational view of the hair perm rod of the fifth embodiment of the first preferred embodiment of the present invention showing the outer wall surface of the end wall or end cap having a plurality slightly tapered U-shaped channels and also having a plurality of radial notches therein.

The hair perm rod 500 and its component parts of the fifth embodiment of the first preferred embodiment are represented in FIGS. 8 and 13 of the drawings. Outer wall surface 534 of end wall 532 includes a first plurality of radial, wider and slightly tapered channels 540*a* to 540*d*; and a first plurality of radial notches 542*a* to 542*d* for holding in place in any one of the aforementioned slightly tapered channels 540*a* to 540*d* or notches 542*a* to 542*d* the first end section 128*a* of the elastic band 124. The slightly tapered channels 540*a* to 540*d* and notches 542*a* to 542*d* are arranged in a radial pattern, such that each slightly tapered channel 540*a* to 540*d*; and each notch 542*a* to 542*d* is alternately spaced-apart at a 45° degree angle around the outer wall 534 of end wall 532. Each slightly tapered channel 540*a* to 540*d*; and each notch 542*a* to 542*d* is indented within the outer wall surface 534 and perimeter wall edge 512*e* of cylindrical wall 112, respectively; with each slightly tapered channel 540*a* to 540*d*; and each notch 542*a* to 542*d* having a U-shaped or spherical indentation, respectively. Opening 538 receives spherical end tab 126*a* of elastic band 124.

Outer wall surface 544 of end cap 542 includes a second plurality of radial, wider and slightly tapered channels 540*a*' to 540*d*'; and a second plurality of radial notches 542*a*' to 542*d*' (identical in design, shape and configuration to the slightly tapered channels 540*a* to 540*d* and notches 542*a* to 542*d*) for holding in place in any one of the aforementioned slightly tapered channels with 540*a*' to 540*d*' or notches 542*a*' to 542*d*' the second end section 128*b* of the elastic band 124. The slightly tapered channels 540*a*' to 540*d*'; and notches 542*a*' to 542*d*' are also arranged in a radial pattern, such that each slightly tapered channel 540*a*' to 540*d*'; and each notch 542*a*' to 542*d*' is also alternately spaced-apart at a 45° degree angle around the outer wall surface 544 of end cap 542. Each slightly tapered channel 540*a*' to 540*d*'; and each notch 542*a*' to 542*d*' is indented within the outer wall surface 544 and perimeter wall edge 550*e* of outer cylindrical wall surface 550, respectively; with each slightly tapered channel 540*a*' to 540*d*' having a U-shaped or spherical indentation, respectively. Opening 548 receives spherical end tab 126*b* of elastic band 124.

Alternate embodiments of the hair perm rod of the second preferred embodiment 1100 of the present invention are depicted in detail by FIGS. 18, 19, 20, and 21 of the drawings. All aspects of these alternate hair perm rods 1200, 1300, 1400 and 1500 are the same as the second preferred embodiment of the hair perm rod 1100 except for the arrangement of the notches and channels. In these alternate embodiments, the outer wall surfaces 1134 and 1144; and openings 1138 and 1148; and/or perimeter wall edges 1112*e*, 1132*e*, 1144*e* and 1150*e* of the end wall 1132 and end cap 1142, respectively, which are different.

SIXTH EMBODIMENT 1200

Figure 18:
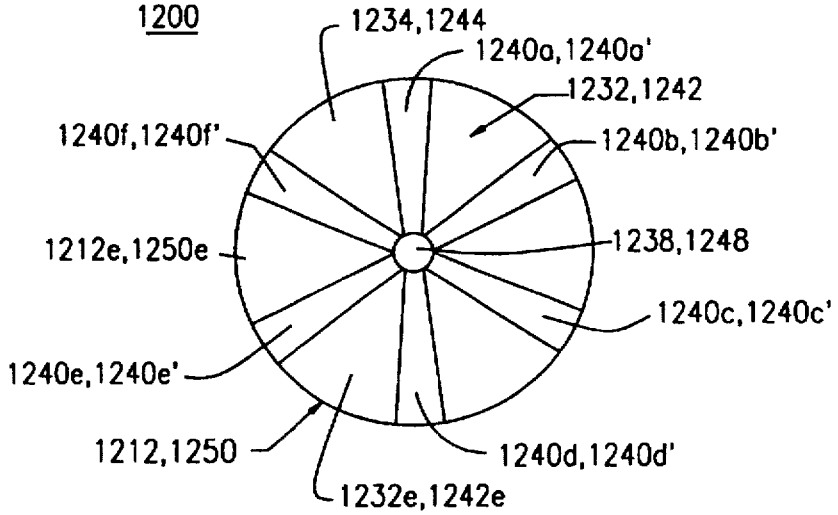
FIG. 18 is an enlarged side elevational view of the hair perm rod of the sixth embodiment of the second preferred embodiment of the present invention showing the outer wall surface of the end wall or end cap having a plurality of tapered U-shaped channels therein.

The hair perm rod 1200 and its component parts of the sixth embodiment of the second preferred embodiment are represented in FIG. 18 of the drawings. Outer wall surface 1234 of end wall 1232 includes a first plurality of radial tapered channels 1240*a* to 1240*f* for holding in place in any one of the aforementioned tapered channels 1240*a* to 1240*f* the first end section 128*a* of the elastic band 124. The tapered channels 1240*a* to 1240*f* are arranged in a radial pattern, such that each tapered channel 1240*a* to 1240*f* is spaced-apart at a 60° degree angle around the outer wall 1234 of end wall 1232. Each tapered channel 1240*a* to 1240*f* is indented within the outer wall surface 1234 and perimeter wall edge 1212*e* of cylindrical wall 1212, respectively; with each slightly tapered channel 1240*a* to 1240*f* having a U-shaped indentation. Opening 1238 receives spherical end tab 126*a* of elastic band 124.

Outer wall surface 1244 of end cap 1242 includes a second plurality of radial tapered channels 1240*a*' to 1240*f* (identical in design, shape and configuration to tapered channels 1240*a* to 1240*f*) for holding in place in any one of the aforementioned tapered channels 1240*a*' to 1240*f* the second end section 128*b* of the elastic band 124. The tapered channels 1240*a*' to 1240*f* are also arranged in a radial pattern, such that each slightly tapered channel 1240*a*' to 1240*f* is also spaced-apart at a 60° degree angle around the outer wall surface 1244 of end cap 1242. Each tapered channel 1240*a*' to 1240*f* is indented within the outer wall surface 1244 and perimeter wall edge 1250*e* of outer cylindrical wall surface 1250, respectively; with each tapered channel 1240*a*' to 1240*f* having a U-shaped indentation. Opening 1248 receives spherical end tab 126*b* of elastic band 124.

SEVENTH EMBODIMENT 1300

Figure 19:
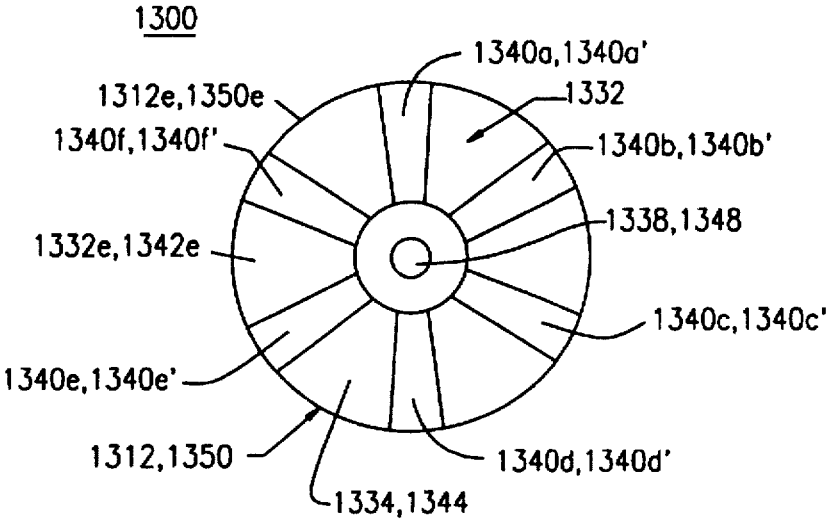
FIG. 19 is an enlarged side elevational view of the hair perm rod of the seventh embodiment of the second preferred embodiment of the present invention showing the outer wall surface of the end wall or end cap having a plurality of slightly tapered U-shaped channels therein.

The hair perm rod 1300 and its component parts of the seventh embodiment of the second preferred embodiment are represented in FIG. 19 of the drawings. Outer wall surface 1334 of end wall 1332 includes a first plurality of radial, wider and slightly tapered channels 1340*a* to 1340*f* for holding in place in any one of the aforementioned slightly tapered channels 1340*a* to 1340*f* the first end section 128*a* of the elastic band 124. The slightly tapered channels 1340*a* to 1340*f* are arranged in a radial pattern, such that each slightly tapered channel 1340*a* to 1340*f* is spaced-apart at a 60° degree angle around the outer wall 1334 of end wall 1332. Each slightly tapered channel 1340*a* to 1340*f* is indented within the outer wall surface 1334 and perimeter wall edge 1312*e* of cylindrical wall 1312, respectively; with each slightly tapered channel 1340*a* to 1340*f* having a U-shaped indentation. Opening 1338 receives spherical end tab 126*a* of elastic band 124.

Outer wall surface 1344 of end cap 1342 includes a second plurality of radial, wider and slightly tapered channels 1340*a*' to 1340*f* (identical in design, shape and configuration to tapered channels 1340*a* to 1340*f*) for holding in place in any one of the aforementioned slightly tapered channels 1340*a*' to 1340*f* the second end section 128*b* of the elastic band 124. The slightly tapered channels 1340*a*' to 1340*f* are also arranged in a radial pattern, such that each slightly tapered channel 1340*a*' to 1340*f* is also spaced-apart at a 60° degree angle around the outer wall surface 1344 of end cap 1342. Each slightly tapered channel 1340*a*' to 1340*f* is indented within the outer wall surface 1344 and perimeter wall edge 1350*e* of outer cylindrical wall surface 1350, respectively; with each slightly tapered channel 1340*a*' to 1340*f* having a U-shaped indentation. Opening 1348 receives spherical end tab 1266 of elastic band 124.

EIGHTH EMBODIMENT 1400

Figure 20:
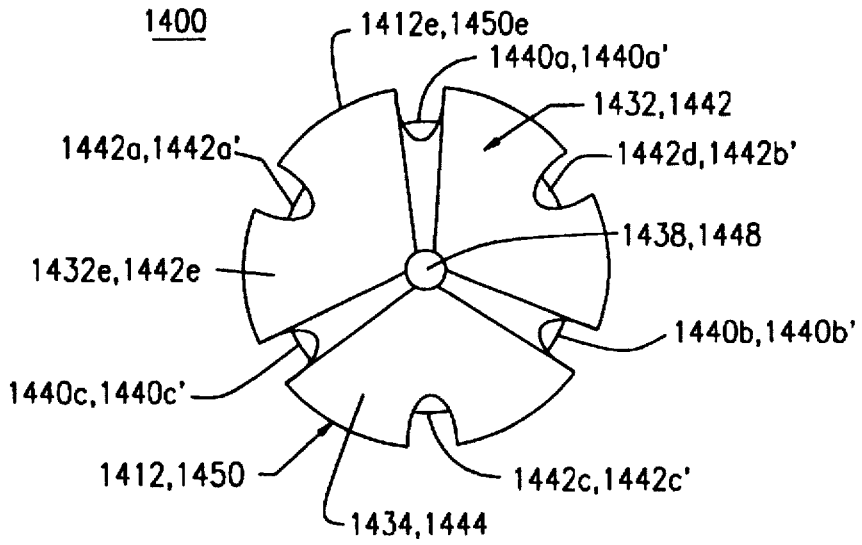
FIG. 20 is an enlarged side elevational view of the hair perm rod of the eighth embodiment of the second preferred embodiment of the present invention showing the outer wall surface of the end wall or end cap having a plurality of tapered U-shaped channels with notches; and having a plurality of radial notches therein.

The hair perm rod 1400 and its component parts of the eighth embodiment of the second preferred embodiment are represented in FIG. 20 of the drawings. Outer wall surface 1434 of end wall 1432 includes a first plurality of radial, wider and slightly tapered channels 1440*a* to 1440*c*; and a first plurality of radial notches 1442*a* to 1442*c* for holding in place in any one of the aforementioned tapered channels with notches 1440*a* to 1440*c* or notches 1442*a* to 1442*c* the first end section 128*a* of the elastic band 124. The tapered channels with notches 1440*a* to 1440*c* and notches 1442*a* to 1442*c* are arranged in a radial pattern, such that each tapered channel with a notch 1440*a* to 1440*c*; and each notch 1442*a* to 1442*c* is alternately spaced-apart at a 60° degree angle around the outer wall surface 1434 of end wall 1432. Each tapered channel with a notch 1440*a* to 1440*c*; and each notch 1442*a* to 1442*c* is indented within the outer wall surface 1434 and perimeter wall edge 1412*e* of cylindrical wall 1412, respectively; with each tapered channel with a notch 1440*a* to 1440*c* and each notch 1442*a* to 1442*c* having a U-shaped or spherical indentation, respectively. Opening 1438 receives spherical end tab 126*a* of elastic band 124.

Outer wall surface 1444 of end cap 1442 includes a second plurality of radial tapered channels with notches 1440*a*' to 1440*c*'; and a second plurality of radial notches 1442*a*' to 1442*c*' (identical in design, shape and configuration to tapered channels with notches 1440*a* to 1440*c* and notches 1442*a* to 1442*c*) for holing in place in any one of the aforementioned tapered channels with notches 1440*a*' to 1440*c*' or notches 1442*a*' to 1442*c*' the second end section 128*b* of the elastic band 124. The tapered channels with notches 1440*a*' to 1440*c*'; and notches 1442*a*' to 1442*c*' are also arranged in a radial patter, such that each tapered channel with a notch 1440*a*' to 1440*c*'; and each notch 442*a*' to 442*c*' is also alternately spaced-apart at a 60° degree angle around the outer wall surface 1444 of end cap 1442. Each tapered channel with a notch 1440*a*' to 1440*c*', and each notch 1442*a*' to 1442*c*' is indented within the outer wall surface 1444 and perimeter wall edge 1450*e* of outer cylindrical wall surface 1450, respectively; with each tapered channel with a notch 1440*a*, to 1440*c*', and each notch 1442*a*' to 1442*c*' having a U-shaped or spherical indentation, respectively. Opening 1448 receives spherical end tab 126*b* of elastic band 124.

NINTH EMBODIMENT 1500

Figure 21:
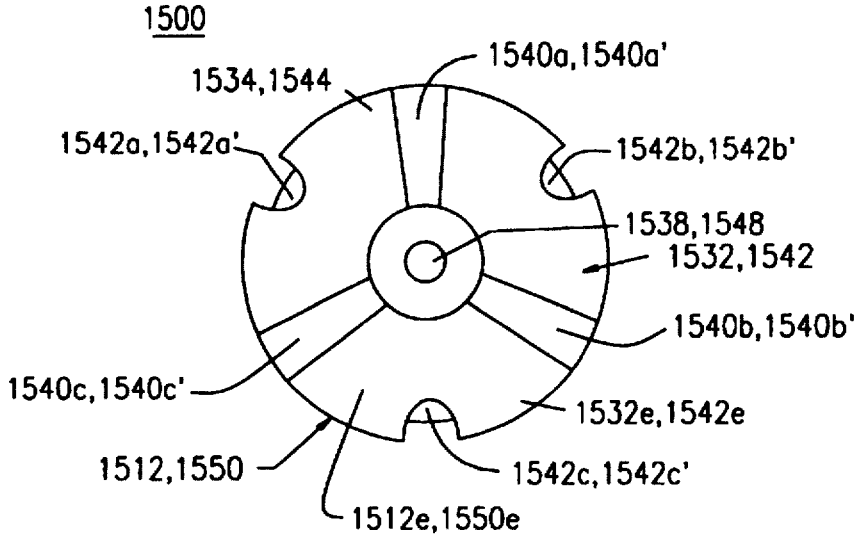
FIG. 21 is an enlarged side elevational view of the hair perm rod of the ninth embodiment of the second preferred embodiment of the present invention showing the outer wall surface of the end wall or end cap having a plurality of slightly tapered U-shaped channels; and having a plurality of radial notches therein.

The hair perm rod 1500 and its component parts of the ninth embodiment of the second preferred embodiment are represented in FIG. 21 of the drawings. Outer wall surface 1534 of end wall 1532 includes a first plurality of radial, wider and slightly tapered channels 1540*a* to 1540*c*; and a first plurality of radial notches 1542*a* to 1542*c* for holding in place in any one of the aforementioned slightly tapered channels 1540*a* to 1540*c* or notches 1542*a* to 1542*c* the first end section 128*a* of the elastic band 124. The slightly tapered channels 1540*a* to 1540*c* and notches 1542*a* to 1542*c* are arranged in a radial patter, such that each slightly tapered channel 1540*a* to 1540*c*; and each notch 1542*a* to 1542 is alternately spaced-apart at a 60° degree angle around the outer wall 1534 of end wall 1532. Each slightly tapered channel 1540*a* to 1540*c*; and each notch 1542*a* to 1542*c* is indented within the outer wall surface 1534 and perimeter wall edge 1512*e* of cylindrical wall 1512, respectively; with each slightly tapered channel 1540*a* to 1540*c*; and each notch 1542*a* to 1542*c* having a U-shaped or spherical indentation, respectively. Opening 1538 receives spherical end tab 126*a* of elastic band 124.

Outer wall surface 1544 of end cap 1542 includes a second plurality of radial, wider and slightly tapered channels 1540*a*' to 1540*c*'; and a second plurality of radial notches 1542*a*' to 1542*c*' (identical in design, shape and configuration to the slightly tapered channels 1540*a* to 1540*c* and notches 1542*a* to 1542*c*) for holding in place in any one of the aforementioned slightly tapered channels with 1540*a*' to 1540*c*' or notches 1542*a*' to 1542*c*' the second end section 128*b* of the elastic band 124. The slightly tapered channels 1540*a*' to 1540*c*', and notches 1542*a*' to 1542*c*' are also arranged in a radial patter, such that each slightly tapered channel 1540*a*' to 1540*c*' and each notch 1542*a*' to 1542*c*' is also alternately spaced-apart at a 60° degree angle around the outer wall surface 1544 of end cap 1542. Each slightly tapered channel 1540*a*' to 1540*c*'; and each notch 1542*a*' to 1542*c*' is indented within the outer wall surface 1544 and perimeter wall edge 1550*e* of outer cylindrical wall surface 1550, respectively, with each slightly tapered channel 1540*a*' to 1540*c*', and each notch 1542*a*' to 1542*c*' having a U-shaped or spherical indentation, respectively. Opening 1548 receives spherical end tab 126*b* of elastic band 124.

Alternate embodiments of the hair perm rod of the third preferred embodiment 2100 of the present invention are depicted in detail by FIGS. 26, 27, 28, and 29 of the drawings. All aspects of these alternate hair perm rods 2200, 2300, 2400 and 2500 are the same as the third preferred embodiment of the hair perm rod 2100 except for the arrangement of the notches and channels. In these alternate embodiments, the outer wall surfaces 2134 and 2144 and/or perimeter wall edges 2112*e*, 2132*e*, 2144*e* and 2150*e* of the end wall 2132 and end cap 2142, respectively, which are different.

TENTH EMBODIMENT 2200

Figure 26:
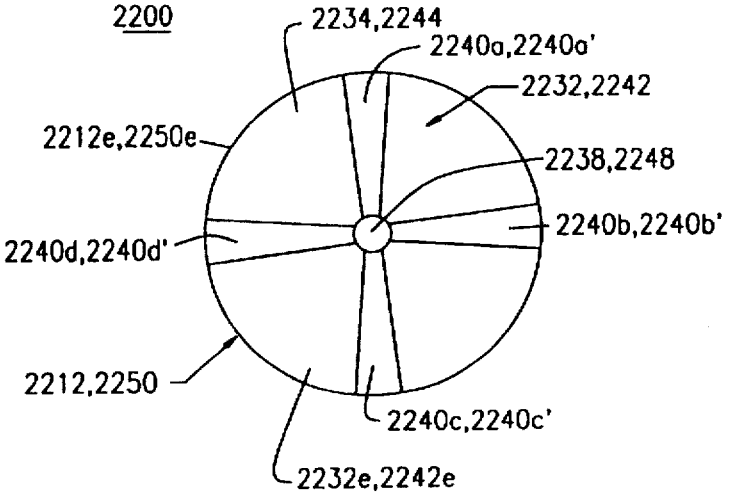
FIG. 26 is an enlarged side elevational view of the hair perm rod of the tenth embodiment of the third preferred embodiment of the present invention showing the outer wall surface of the end wall or end cap having a plurality of tapered U-shaped channels therein.

The hair perm rod 2200 and its component parts of the tenth embodiment of the third preferred embodiment are represented in FIG. 26 of the drawings. Outer wall surface 2234 of end wall 2232 includes a first plurality of radial tapered channels 2240*a* to 2240*d* for holding in place in any one of the aforementioned tapered channels 2240*a* to 2240*d* the first end section 128*a* of the elastic band 124. The slightly tapered channels 2240*a* to 2240*d* are arranged in a radial pattern, such that each tapered channel 2240*a* to 2240*d* is spaced-apart at a 90° degree angle around the outer wall surface 2234 of end wall 2232. Each tapered channel 2240*a* to 2240*d* is indented within the outer wall surface 2234 and perimeter wall edge 2212*e* of cylindrical wall 2212, respectively; with each slightly tapered channel 2240*a* to 2240*d* having a U-shaped indentation. Opening 2238 receives spherical tab end 126*a* of elastic band 124.

Outer wall surface 2244 of end cap 2242 includes a second plurality of radial tapered channels 2240*a*' to 2240*d*' (identical in design, shape and configuration to tapered channels 2240*a* to 2240*d*) for holding in place in any one of the aforementioned tapered channels 2240*a*' to 2240*d*' the second end section 128*b* of the elastic band 124. The tapered channels 2240*a*' to 2240*d*' are also arranged in a radial pattern, such that each tapered channel 2240*a*' to 2240*d*' is also spaced-apart at a 90° degree angle around the outer wall surface 2244 of end cap 2242. Each tapered channel 2240*a*' to 2240*d*' is indented within the outer wall surface 2244 and perimeter wall edge 2250e of outer cylindrical wall surface 2250, respectively, with each tapered channel 2240*a*' to 2240*d*' having a U-shaped indentation. Opening 2248 receives spherical tab end 126*b* of elastic band 124.

ELEVENTH EMBODIMENT 2300

Figure 27:
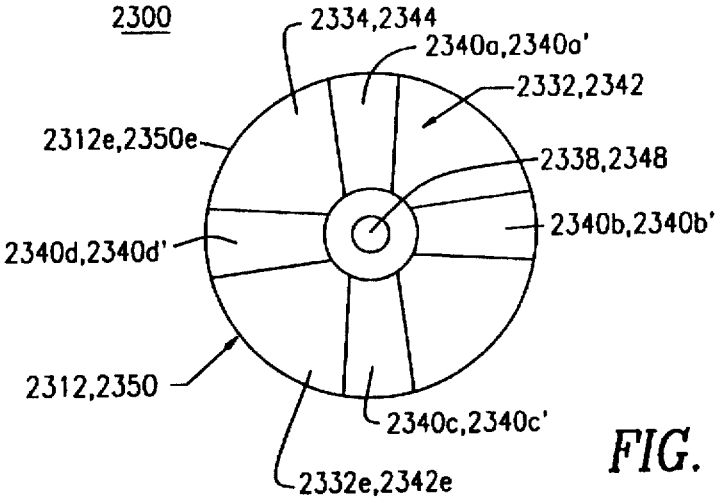
FIG. 27 is an enlarged side elevational view of the hair perm rod of the eleventh embodiment of the third preferred embodiment of the present invention showing the outer wall surface of the end wall or end cap having a plurality of slightly tapered U-shaped channels therein.

The hair perm rod 2300 and its component parts of the eleventh embodiment of the third preferred embodiment are represented in FIG. 27 of the drawings. Outer wall surface 2334 of end wall 2332 includes a first plurality of radial, wider and slightly tapered channels 2340*a* to 2340*d* for holding in place in any one of the aforementioned slightly tapered channels 2340*a* to 2340*d* the first end section 128*a* of the elastic band 124. The slightly tapered channels 2340*a* to 2340*d* are arranged in a radial pattern, such that each slightly tapered channel 2340*a* to 2340*d* is spaced-apart at a 60° degree angle around the outer wall surface 2334 of end wall 2332. Each slightly tapered channel 2340*a* to 2340*d* is indented within the outer wall surface 2334 and perimeter wall edge 2312*e* of cylindrical wall 2312, respectively; with each slightly tapered channel 2340*a* to 2340*d* having a U-shaped indentation. Opening 2338 receives spherical tab end 126*a* of elastic band 124.

Outer wall surface 2344 of end cap 2342 includes a second plurality of radial, wider and slightly tapered channels 2340*a*' to 2340*d*' (identical in design, shape and configuration to tapered channels 2340*a* to 2340*d*) for holding in place in any one of the aforementioned slightly tapered channels 2340*a*' to 2340*d*' the second end section 128*b* of the elastic band 124. The slightly tapered channels 2340*a*' to 2340*d*' are also arranged in a radial pattern, such that each slightly tapered channel 2340*a*' to 2340*d*' is also spaced-apart at a 60° degree angle around the outer wall surface 2344 of end cap 2342. Each slightly tapered channel 2340*a*' to 2340*d*' is indented within the outer wall surface 2344 and perimeter wall edge 2350*e* of outer cylindrical wall surface 2350, respectively, with each slightly tapered channel 2340*a*' to 2340*d*' having a U-shaped indentation. Opening 2348 receives spherical tab end 126*b* of elastic band 124.

TWELFTH EMBODIMENT 2400

Figure 28:
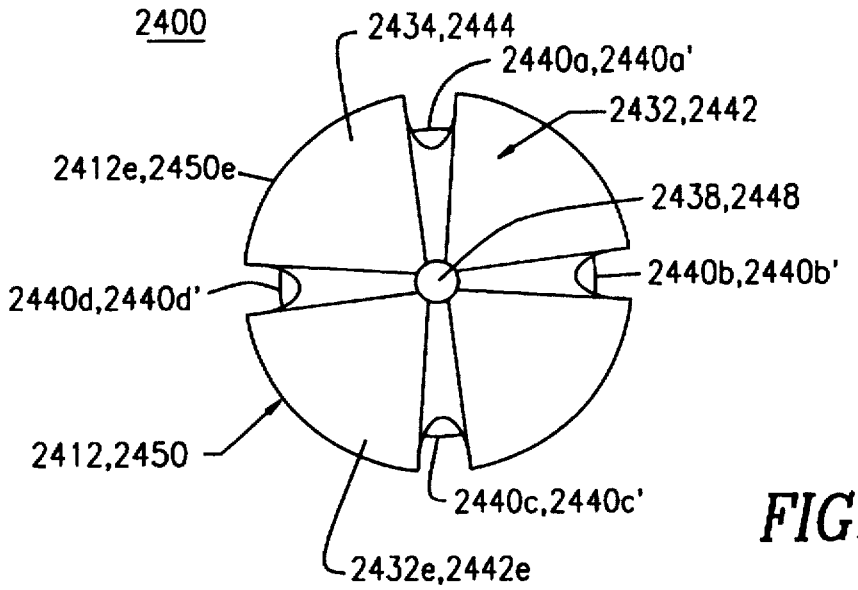
FIG. 28 is an enlarged side elevational view of the hair perm rod of the twelfth embodiment of the third preferred embodiment of the present invention showing the outer wall surface of the end wall or end cap having a plurality of tapered U-shaped channels with notches therein.

The hair perm rod 2400 and its component parts of the twelfth embodiment of the third preferred embodiment are represented in FIG. 28 of the drawings. Outer wall surface 2434 of end wall 2432 includes a first plurality of radial tapered channels with notches 2440*a* to 2440*d*; for holding in place in any one of the aforementioned tapered channels with notches 2440*a* to 2440*d* the first end section 128*a* of the elastic band 124. The tapered channels with notches 2440*a* to 2440*d* are arranged in a radial pattern, such that each tapered channel 2440*a* to 2440*d* is spaced-apart at a 90° degree angle around the outer wall surface 2434 of end wall 2432. Each tapered channel with a notch 2440*a* to 2440*d* is indented within the outer wall surface 2434 and perimeter wall edge 2412*e* of cylindrical wall 2412, respectively; with each tapered channel with a notch 2440*a* to 2440*d* having a U-shaped or spherical indentation respectively. Opening 2438 receives spherical tab end 126*a* of elastic band 124.

Outer wall surface 2444 of end cap 2442 includes a second plurality of radial tapered channels with notches 2440*a*' to 2440*d*' (identical in design, shape and configuration to tapered channels with notches 2440*a* to 2440*d*) for holding in place in any one of the aforementioned tapered channels with notches 2440*a*' to 2440*d*' the second end section 128*b* of the elastic band 124. The tapered channels with notches 2440*a*' to 2440*d*' are also arranged in a radial pattern, such that each tapered channel with a notch 2440*a*' to 2440*d*' also spaced-apart at a 90° degree angle around the outer wall surface 2444 of end cap 2442. Each tapered channel with a notch 2440*a*' to 2440*d*' is indented within the outer wall surface 2444 and perimeter wall edge 2450*e* of outer cylindrical wall surface 2450, respectively; with each tapered channel with a notch 2440*a*' to 2440*d*' having a U-shaped or spherical indentation, respectively. Opening 2448 receives spherical end tab 126*b* of elastic band 124.

THIRTEENTH EMBODIMENT 2500

Figure 29:
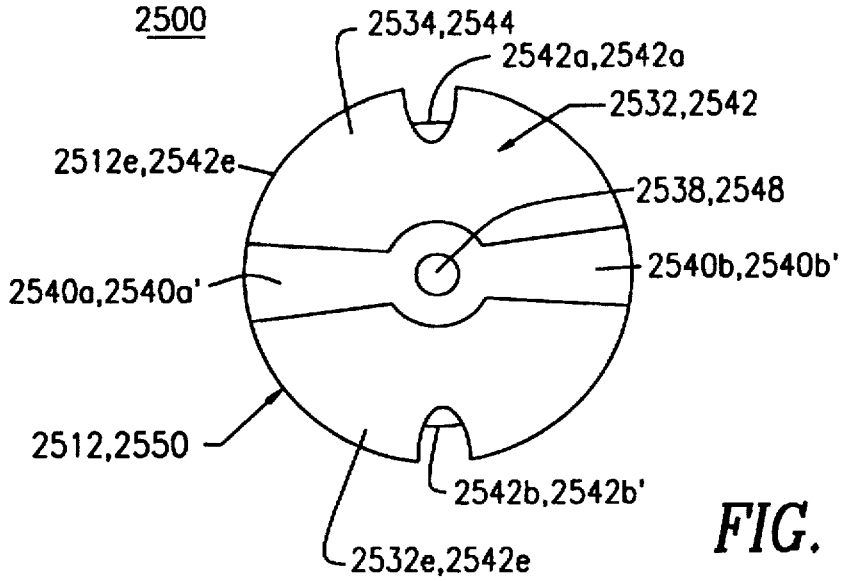
FIG. 29 is an enlarged side elevational view of the hair perm rod of the thirteenth embodiment of the third preferred embodiment of the present invention showing the outer wall surface of the end wall or end cap having a pair of slightly tapered U-shaped channels; and having a pair of radial notches therein.

The hair perm rod 2500 and its component parts of the thirteenth embodiment of the third preferred embodiment are represented in FIG. 29 of the drawings. Outer wall surface 2534 of end wall 2532 includes a first pair of radial, wider and sightly tapered channels 2540*a* and 2540*b*; and a first pair of radial notches 2542*a* and 2542*b* for holding in place in any one of the aforementioned slightly tapered channels 2540*a* to 2540*b* or notches 2542*a* and 2542*b* the first end section 128*a* of the elastic band 124. The slightly tapered channels 2540*a* and 2540*b* and notches 2542*a* and 2542*b* are arranged in a radial pattern, such that each slightly tapered channel 2540*a* and 2540*b*; and each notch 2542*a* and 2542*b* is alternately spaced-apart at a 90° degree angle around the outer wall 2534 of end wall 2532. Each slightly tapered channel 2540*a* and 2540*b*; and each notch 2542*a* and 2542*b* is indented within the outer wall surface 2534 and perimeter wall edge 2512*e* of cylindrical wall 2512, respectively; with each slightly tapered channel 2540*a* and 2540*b*; and each notch 2542*a* and 2542*b* having a U-shaped or spherical indentation, respectively. Opening 2538 receives spherical end tab 126*a* of elastic band 124.

Outer wall surface 2544 of end cap 2542 includes a second pair of radial, wider and slightly tapered channels 2540*a*' and 2540*d*'; and a second pair of radial notches 2542*a*' and 2542*b*' (identical in design, shape and configuration to the slightly tapered channels 2540*a* and 2540*b* and notches 2542*a* and 2542*b*) for holding in place in any one of the aforementioned slightly tapered channels with 2540*a*' and 2540*b*' or notches 2542*a*' and 2542*b*' the second end section 128*b* of the elastic band 124. The slightly tapered channels 2540*a*' and 2540*b*'; and notches 2542*a*' and 2542*b*' are also arranged in a radial pattern, such that each slightly tapered channel 2540*a*' and 2540*b*' and each notch 2542*a*' and 2542*b*' is also alternately spaced-apart at a 90° degree angle around the outer wall surface 2544 of end cap 2542. Each slightly tapered channel 2540*a*' and 2540*b*'; and each notch 2542*a*' and 2542*b*' is indented within the outer wall surface 2544 and perimeter wall edge 2550*e* of outer cylindrical wall surface 2550, respectively; with each slightly tapered channel 2540*a*' and 2540*b*', and each notch 2542*a*' and 2542*b*' having a U-shaped or spherical indentation, respectively. Opening 2548 receives spherical end tab 126*b* of elastic band 124.

OPERATION OF THE PRESENT INVENTION

In operation, the hairdresser takes a lock of hair 102 from the users' head and winds that particular lock of hair 102 around the perm rod housing 110 of hair perm rod 10 in a clockwise or counter-clockwise manner depending upon the type of curl or perm requested by customer. The hair section 102 is wound around the the perm rod housing 110 between two to three times depending upon the length of the lock of hair section 102 being used. It should be noted the hairdresser may use an end paper (not shown) in conjunction with the winding the lock of hair section 102 around the perm rod housing 110 for better management of the perm procedure. The hair section 102 is held tightly on the perm rod housing 110 due to the plurality of pre-arranged hair gripper teeth 122 on the knurled surface 120 which help grab the strands of hair 102 to the outer wall surface 114 of perm rod housing 110. More importantly, the lock of hair 102 is further held in place against the users' scalp by attaching the center elastic section 128 of the elastic band 124 onto the wound section of hair 102 via the end wall 132 of the perm rod housing 110 and end cap 142 of the hair perm rod 100. In particular, the first and seconds ends 128*a* and 128*b* of elastic band 124 are received within one of the radial notches 140*a* to 140*h* of end wall 132 and are also received within one of the radial notches 140*a*' to 140*h*' of end cap 142, such that the elastic band 124 is adjacent to the users' scalp. This prevents the hair perm rod 100 from unraveling, unwinding or moving that hair section 102 from an immobilized position adjacent to the users' scalp. The aforementioned radial notches 140*a* to 140*h* of end wall 132, and radial notches 140*a*' to 140*h*' prevent the elastic end sections 128*a* and 128*b* from popping-off the end wall 132 and end cap 142, respectively, of the perm rod housing 110 when the elastic band 124 is improperly placed in a longitudinal position along the length of the perm rod housing 110 in relationship of the hair perm rod 100 along the users' scalp area. The placing of the elastic band 124 in a proper notch location within one of the radial notches 140*a* to 140*h* of end wall 132; and within one of the radial notches 140*a*' to 140*h*' of end cap 142 in relationship to the users' scalp will prevent the elastic band ends 128*a* and 128*b* of elastic band 124 from coming out of one of the aforementioned notches of end wall 132 and end cap 142, respectively. It should be noted that end cap 142 is rotatable within the hole opening 130 of rod housing 110 which provides the hairdresser a further fine tuning of the hair perm rod 100 in relationship of the elastic band 124 to the users' scalp.

After the hairdresser has placed a number of hair perm rods 100 in the users' hair with each perm rod 100 having a lock of hair section 102 in place, the hairdresser then applies a chemical perming solution 104 to each lock of hair section 102 where then the plurality of ventilation hole openings 118 of each row 118R located within the cylindrical wall 112 of rod housing 110 help to evaporate the perming solution 104 within each lock of hair section 102 via the use of a hair blower or an overhead hair dryer. After this procedure is concluded by the hairdresser; the hairdresser then removes the end cap 142 and the elastic band 124 from each of the perm rod housings 110 and unwinds each hair section 102 from each of the perm rod housings 110 being used; and the hairdresser then removes each perm rod housings 110 from each hair section 102 that was permed. The hairdresser then combs or brushes out the permed hair 102 as desired by the user.

In using the other embodiments of the hair perm rods 200, 300, 400 and 500 to perm a users' hair 102, they also operate in a similar manner with respect of the elastic band ends 128*a* and 128*b* of elastic band 124 are received within one of the radial tapered channels 240*a* to 240h of end wall 232, and also received within one of the radial tapered channels 240*a*' to 240*h*' of end cap 242, respectively, of hair perm rod 200. This operation of use repeats itself for each end wall and end cap configuration of the subsequent embodiments 300, 400 and 500.

Further, the second preferred embodiment 1100 and its alternate embodiments 1200, 1300, 1400 and 1500; and the third preferred embodiment 2100 and its alternate embodiments 2200, 2300, 2400 and 2500 all operate and function in a similar manner as the first preferred embodiment 100 of the hair perm rod of the present invention, as shown in FIGS. 2, 14, and 22 of the drawings.

ADVANTAGES OF THE PRESENT INVENTION

Accordingly, an advantage of the present invention is that it provides for a hair perm rod that is easy to use and which prevents the hair section being permed from unraveling or unwinding from the hair perm rod when in operational use.

Another advantage of the present invention is that it provides for a hair perm rod that is adjustable such that the hair sections being permed on the hair perm rods are adjacent to the users' scalp, as well as, the hair perm rods are in an immobile position adjacent to the users' scalp.

Another advantage of the present invention is that it provides for a hair perm rod that includes a plurality of radial notches, radial channels or combinations of radial notches and radial channels on the end wall and end cap, respectively, for the receipt of the elastic end sections of an elastic band which prevents the popping-out of the elastic end sections of the elastic band within the aforementioned radial notches and/or radial channels thereof, when in operational use.

Another advantage of the present invention is that it provides for a hair perm rod having an end cap that is detachable, as well as, rotatable within the hole opening of the perm rod housing for further adjusting the hair perm rod and the elastic band in relationship to the hair perm rod being adjacent to the users' scalp for enabling the hair perm rod to continue to be in an immobile position, such that the hair section will not unravel when in operational use.

Another advantage of the present invention is that it provides for a hair perm rod having a plurality of ventilation hole opening arranged in two or more rows along the length of perm rod housing for helping to evaporate the chemical perming solution from the hair sections on the hair perm rods in the hair drying process.

Another advantage of the present invention is that it provides for a hair perm rod having a plurality of pre-arranged hair gripper teeth on a knurled surface in which to help grab the strands of hair to the outer wall surface of the perm rod housing, thus enabling each hair section to be held tightly against the knurled surface of the perm rod housing.

Another advantage of the present invention is that it provides for a hair perm rod having an elastic band or elastic cord with spherical tab ends for retaining the aforementioned tab ends of the elastic band securely to the inner wall surfaces of the end wall and end cap, respectively, in which to prevent the elastic band ends from coming out of the end wall and/or end cap, respectively. A further object of the present invention is to provide a hair perm rod that can be mass produced in an automated and economical manner and being readily affordable by the user or hairdresser.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A hair perm rod for perming hair, comprising:

a) a cylindrical hollow rod including a center section having a knurled surface, and having an attached end wall at one end of said hollow rod; and a detachable end cap at the other end of said hollow rod;

b) a plurality of ventilation and liquid holes formed within said center section of said hollow rod;

c) a plurality of hair gripper teeth formed on said knurled surface of said hollow rod;

d) an elastic band having a first end and a second end for connecting to said end wall and said end cap, respectively;

e) said end wall including a first plurality of notches extending in a radial direction and a center hole formed therein for receiving said first end of said elastic band;

f) said end cap including a second plurality of notches extending in a radial direction and a center hole formed therein for receiving said second end of said elastic band; and g) said elastic band being receivable in one of said first plurality of notches and being receivable in one of said second plurality of notches to hold the hair securely in place.

2. A hair perm rod in accordance with claim 1, further including a first plurality of channels extending in a radial direction within said end wall; and further including a second plurality of channels extending in a radial direction within said end cap.

3. A hair perm rod in accordance with claim 2, wherein said notches and said channels are connected to form a notched channel.

4. A hair perm rod in accordance with claim 2, wherein said channels are tapered.

5. A hair perm rod in accordance with claim 1, wherein said plurality of ventilation and liquid holes are formed into at least two rows along the longitudinal length of said center section of said hollow rod.

6. A hair perm rod in accordance with claim 5, wherein said rows of ventilation and liquid holes are set apart at a 90° angle around the peripheral circumference of said hollow rod.

7. A hair perm rod in accordance with claim 5, wherein said rows of ventilation and liquid holes are set apart at a 120° degree angle around the peripheral circumference of said hollow rod.

8. A hair perm rod in accordance with claim 5, wherein said rows of ventilation and liquid holes are set apart at a 180° degree angle around the peripheral circumference of said hollow rod.

9. A hair perm rod in accordance with claim 1, wherein said plurality of hair gripper teeth are formed in multiple rows of a pre-determined pattern on said knurled surface of said hollow rod.

10. A hair perm rod in accordance with claim 1, wherein said end wall has a perimeter edge and said end cap has a perimeter edge and wherein said first and second plurality of notches are set apart at a 45° degree angle and are formed in said perimeter edges of said end wall and said end cap, respectively.

11. A hair perm rod in accordance with claim 1, wherein said end wall has a perimeter edge and said end cap has a perimeter edge and wherein said first and second plurality of notches are set apart at a 60° degree angle and are formed in said perimeter edges of said end wall and said end cap, respectively.

12. A hair perm rod in accordance with claim 1, wherein said end wall has a perimeter edge and said end cap has a perimeter edge and wherein said first and second plurality of notches are set apart at a 90° degree angle and are formed in said perimeter edges of said end wall and said end cap, respectively.

13. A hair perm rod in accordance with claim 1, wherein said center section of said cylindrical hollow rod includes a concave cylindrical wall for making a smaller and tighter curl on the hair.

14. A hair perm rod in accordance with claim 1, wherein said first and second ends of said elastic band are knotted ends for retention within said center hole at said end wall and said end cap, respectively.

15. A hair perm rod in accordance with claim 1, wherein said hair perm rod is made from a moldable, heavy duty plastic being durable and cleanable for multiple and repeated use.

16. A hair perm rod for perming hair, comprising:

a) a cylindrical hollow rod including a center section having a knurled surface, and having an attached end wall at one end of said hollow rod; and a detachable end cap at the other end of said hollow rod;

b) a plurality of ventilation and liquid holes formed within said center section of said hollow rod;

c) a plurality of hair gripper teeth formed on said knurled surface of said hollow rod;

d) an elastic band having a first end and a second end for connecting to said end wall and said end cap, respectively;

e) said end wall including a first plurality of channels extending in a radial direction and a center hole formed therein for receiving said first end of said elastic band;

f) said end cap including a second plurality of channels extending in a radial direction and a center hole formed therein for receiving said second end of said elastic band; and g) said elastic band being receivable in one of said first plurality of channels and being receivable in one of said second plurality of channels to hold the hair securely in place.

17. A hair perm rod in accordance with claim 16, wherein said channels are tapered.

18. A hair perm rod in accordance with claim 16, wherein said plurality of ventilation and liquid holes are formed into at least two rows along the longitudinal length of said center section of said hollow rod.

19. A hair perm rod in accordance with claim 18, wherein said rows of ventilation and liquid holes are set apart at a 90° angle around the peripheral circumference of said hollow rod.

20. A hair perm rod in accordance with claim 18, wherein said rows of ventilation and liquid holes are set apart at a 120° degree angle around the peripheral circumference of said hollow rod.

21. A hair perm rod in accordance with claim 18, wherein said rows of ventilation and liquid holes are set apart at a 180° degree angle around the peripheral circumference of said hollow rod.

22. A hair perm rod in accordance with claim 16, wherein said plurality of hair gripper teeth are formed in multiple rows of a pre-determined pattern on said knurled surface of said hollow rod.

23. A hair perm rod in accordance with claim 16, wherein said end wall has a perimeter edge and said end cap has a perimeter edge, and wherein said first and second plurality of channels are set apart at a 45° degree angle and are formed in said perimeter edges of said end wall and said end cap, respectively.

24. A hair perm rod in accordance with claim 16, wherein said end wall has a perimeter edge and said end cap has a perimeter edge, and wherein said first and second plurality of channels are set apart at a 60° degree angle and are formed in said perimeter edges of said end wall and said end cap, respectively.

25. A hair perm rod in accordance with claim 16, wherein said end wall has a perimeter edge and said end cap has a perimeter edge, and wherein said first and second plurality of channels are set apart at a 90° degree angle and are formed in said perimeter edges of said end wall and said end cap, respectively.

26. A hair perm rod in accordance with claim 16, wherein said center section of said cylindrical hollow rod includes a concave cylindrical wall for making a smaller and tighter curl on the hair.

27. A hair perm rod in accordance with claim 16, wherein said first and second ends of said elastic band include spherical tab ends for retention within said center hole at said end wall and said end cap, respectively.

28. A hair perm rod in accordance with claim 16, wherein said hair perm rod is made from a moldable, heavy duty plastic being durable and cleanable for multiple and repeated use.

29. A hair perm rod for perming hair, comprising:

a) a hollow rod including a center section and having an attached end wall at one end of said hollow rod, and a detachable end cap at the other end of said hollow rod;

b) a plurality of ventilation and liquid holes formed within said center section of said hollow rod;

c) an elastic band having a first end and a second end for connecting to said end wall and said end cap, respectively;

d) said end wall including first notches and channels formed therein for receiving said first end of said elastic band;

e) said end cap including second notches and channels formed therein for receiving said second end of said elastic band; and f) said elastic band being receivable in said first notches and channels and being receivable in said second notches and channels to hold the hair securely in place.

* * * * *